US012006645B2

(12) United States Patent
Zha et al.

(10) Patent No.: US 12,006,645 B2
(45) Date of Patent: Jun. 11, 2024

(54) AUTOMATIC SNOW REMOVAL DEVICE AND SAFE SNOW THROWING METHOD THEREOF

(71) Applicant: Positec Power Tools (Suzhou) Co., Ltd, Jiangsu (CN)

(72) Inventors: Xiahong Zha, Jiangsu (CN); Fengli Zhao, Jiangsu (CN); Kun Cheng, Jiangsu (CN)

(73) Assignee: POSITEC POWER TOOLS (SUZHOU) CO., LTD, JiangSu (CN)

( * ) Notice: Subject to any disclaimer, the term of this patent is extended or adjusted under 35 U.S.C. 154(b) by 944 days.

(21) Appl. No.: 16/808,039

(22) Filed: Mar. 3, 2020

(65) Prior Publication Data

US 2020/0299912 A1 Sep. 24, 2020

Related U.S. Application Data

(63) Continuation of application No. PCT/CN2018/104000, filed on Sep. 4, 2018.

(30) Foreign Application Priority Data

Sep. 4, 2017 (CN) ..... 201710787859.5
Sep. 28, 2017 (CN) ..... 201710895458.1
Sep. 28, 2017 (CN) ..... 201721257328.7

(51) Int. Cl.
*E01H 5/09* (2006.01)

(52) U.S. Cl.
CPC ..... *E01H 5/098* (2013.01)

(58) Field of Classification Search
CPC .. E01H 5/045; E01H 5/08; E01H 5/09; E01H 5/098
See application file for complete search history.

(56) References Cited

U.S. PATENT DOCUMENTS 3,497,263 A * 2/1970 Heth ..... E01H 5/045 406/162
4,138,829 A * 2/1979 Chase ..... E01H 5/045 193/2 A (Continued)

FOREIGN PATENT DOCUMENTS

CN 1904215 A 1/2007
CN 202809549 U 3/2013

(Continued)

*Primary Examiner* — Jamie L McGowan
(74) *Attorney, Agent, or Firm* — Lee & Hayes P.C.

(57) ABSTRACT

A self-moving snow removal device and a safe snow throwing method protecting a human or an object from damage by snow or miscellaneous matter. The snow removal device includes: a moving module, driving the snow removal device to move; a working module, including a working motor and a snow throwing mechanism, where the snow throwing mechanism is driven by the working motor to collect accumulated snow and miscellaneous matter on the ground and throw the accumulated snow and miscellaneous matter out of the snow throwing mechanism, and a maximum height of a thrown object in the air from the ground is referred to as a snow throwing height; and a control module, configured to control the working module or the moving module to enable the snow throwing height to be less than a predetermined snow throwing height threshold.

20 Claims, 12 Drawing Sheets

(56) References Cited

U.S. PATENT DOCUMENTS

| | | | | |
|---|---|---|---|---|
| 4,761,901 | A * | 8/1988 | Szafarz | B26D 7/22 15/378 |
| 5,163,239 | A * | 11/1992 | Lampe | E01H 5/045 37/260 |
| 6,568,106 | B2 * | 5/2003 | Takeuchi | E01H 5/045 37/262 |
| 7,841,111 | B2 * | 11/2010 | Sueshige | E01H 5/045 37/260 |
| 8,938,894 | B2 * | 1/2015 | Raasch | E01H 5/098 37/261 |
| 10,113,280 | B2 * | 10/2018 | Letsky | G05D 1/0231 |
| 2002/0170208 | A1 * | 11/2002 | Hancock | E01H 5/045 37/248 |
| 2013/0104509 | A1 * | 5/2013 | MacKinnon | A01D 34/78 701/22 |
| 2014/0180478 | A1 | 6/2014 | Letsky | |
| 2015/0013196 | A1 * | 1/2015 | Strange | E01H 5/045 37/251 |
| 2015/0068074 | A1 * | 3/2015 | Mast | E01H 5/098 37/197 |
| 2016/0281310 | A1 * | 9/2016 | Muntasser | E04D 15/006 |
| 2016/0340846 | A1 * | 11/2016 | Prasad | E01H 5/076 |
| 2019/0003137 | A1 * | 1/2019 | Gao | G01S 15/93 |
| 2020/0299912 | A1 * | 9/2020 | Zha | E01H 5/045 |

FOREIGN PATENT DOCUMENTS

| | | | |
|---|---|---|---|
| CN | 106245571 | A | 12/2016 |
| CN | 107044103 | A | 8/2017 |
| SU | 1668525 | A1 | 8/1991 |
| WO | 2010114623 | A2 | 10/2010 |
| WO | 2010114623 | A3 | 10/2010 |
| WO | 2017207823 | A1 | 12/2017 |

* cited by examiner

AUTOMATIC SNOW REMOVAL DEVICE AND SAFE SNOW THROWING METHOD THEREOF

This application is a Continuation Application of International Application No. PCT/CN2018/104000, filed on Sep. 4, 2018, which claims benefit of and priority to Chinese Patent Application No. 201710787859.5, filed on Sep. 4, 2017, Chinese Patent Application No. 201710895458.1, filed on Sep. 28, 2017 and Chinese Patent Application No. 201721257328.7, filed on Sep. 28, 2017, all of which are hereby incorporated by reference in their entirety for all purposes as if fully set forth herein.

TECHNICAL FIELD

The present invention relates to the field of intelligent control, and in particular, to a self-moving snow removal device and a safe snow throwing method.

RELATED ART

A lot of accumulated snow is piled on roads after snowing in winter and severely obstructs traffic. Ice and snow on roads are mainly manually removed, melted, or mechanically removed. It is laborious and inefficient to clean snow manually. Use of thermal energy or distribution of chemicals to help melt accumulated snow requires high energy consumption and high costs, tends to contaminate and corrode the environment and roads, and is only suitable for some special scenarios. Currently used mechanical snow removal devices are not entirely satisfactory because such devices have large volumes, complex structures, and relatively high costs, remove snow inadequately, and are destructive to roads.

At present, a small mechanical snow plow truck mainly includes a prime mover, a transmission apparatus, a snow collection apparatus, a snow throwing apparatus, and an operating apparatus. The prime mover may be a motor or an engine, and at present is mostly a gasoline engine or a diesel engine. The snow collection apparatus is used to collect accumulated snow, and is mainly a snow shovel, a spiral auger, a rubber roller brush or the like. The snow throwing apparatus throws the collected accumulated snow to a side of a road or into the snow collection apparatus. Main manners include a snow throwing impeller and an air blower. The operation apparatus mainly controls the operation of a device, and is pushed with hands to enable the machine to move forward and steer. In this way, an ice/snow remover is manually pushed to keep moving forward, so that accumulated ice and accumulated snow are continuously cleaned.

To reduce the labor intensity of an operator, some self-moving snow plows are used. That is, the snow plows are driven by a prime mover to move. Various mechanical transmission apparatuses are used to implement efficient snow removal and keep the snow plows moving forward, thereby greatly reducing required labor.

An intelligent snow sweeper is not provided in the prior art. The intelligent snow sweeper should have high level of automation. A snow removal device that requires low use costs, saves the labor and time of a user, and removes snow adequately rapidly remove accumulated snow after snowing, thereby facilitating traffic.

Chinese Priority Application No. 201710065902.7 (referred to as Chinese Patent Application No. CN201710065902.7), entitled "Self-moving Snow Removal Device" by the same applicant (Positec Power Tool (Suzhou) Co., Ltd), proposes an intelligent snow sweeper with high level of intelligence, and further proposes a self-moving snow removal device that control the impulse of miscellaneous matter leaving a snow throwing mechanism to protect a human or an object from damage by thrown miscellaneous matter. The priority application is incorporated in the present application by reference in its entirety like the complete content being recorded herein.

There is no safe control solution of controlling a snow throwing height to protect a human or an object from damage in the prior art.

SUMMARY

In view of the foregoing cases, the present invention is proposed.

According to an aspect of the present invention, provides a self-moving snow removal device protecting a human or an object from damage by thrown snow or miscellaneous matter, comprising: a moving module, driving the snow removal device to move; a working module, comprising a working motor and a snow throwing mechanism driven by the working motor, wherein the snow throwing mechanism is driven by the working motor to collect accumulated snow and miscellaneous matter on the ground and throw the accumulated snow and miscellaneous matter out of the snow throwing mechanism, and a maximum height of a thrown object in the air from the ground is referred to as a snow throwing height; and a control module, configured to control the working module or the moving module to enable the snow throwing height to be not greater than a predetermined snow throwing height threshold.

In an embodiment, the predetermined snow throwing height threshold is 0.8 meters to 1.1 meters.

In an embodiment, the predetermined snow throwing height threshold is 0.8 meters.

In an embodiment, the snow throwing mechanism comprises a snow removing head rotating around a central axis, and the working motor drives the snow removing head to rotate to collect accumulated snow and miscellaneous matter on the ground into the snow throwing mechanism; and the control module is configured to: when it is detected that a throwing speed reaches a predetermined speed threshold, control the snow throwing height to be less than the predetermined snow throwing height threshold.

In an embodiment, a value range of the predetermined speed threshold is 18 meter/second to 19 meter/second.

In an embodiment, the radius of the snow removing head is 0.088 meters, and a rotational speed of the snow removing head is 1800 revolutions/minute to 2000 revolutions/minute.

In an embodiment, a speed at which the snow throwing mechanism throws the thrown object is referred to as a throwing speed, an initial throwing angle relative to a horizontal direction is a throwing angle, and the height of a throwing point is an initial height, wherein at least one of the throwing speed, the throwing angle, and the initial height is controlled to control the snow throwing height.

In an embodiment, the radius of a snow removing head is 0.08 meters to 0.12 meters, a rotational speed of the snow removing head is 1500 revolutions/minute to 2500 revolutions/minute, and a value range of the predetermined snow throwing height threshold is 0.8 meters to 1.1 meters.

In an embodiment, the initial height is controlled to be 200 mm to 800 mm.

In an embodiment, the throwing speed is controlled to be 15 m/s to 20 m/s.

In an embodiment, the throwing angle is controlled to be −10 degrees to 25 degrees.

In an embodiment, the throwing speed is controlled to be 15 m/s to 20 m/s, and the throwing angle is controlled to be −10 degrees to 25 degrees.

In an embodiment, the throwing speed is controlled to be 15 m/s to 20 m/s, the throwing angle is controlled to be −10 degrees to 25 degrees, and the initial height is controlled to be 200 mm to 800 mm.

In an embodiment, the radius of the snow removing head is 0.08 m to 0.12 m, and a rotational speed of the snow removing head is controlled to be 1500 revolutions/minute to 2500 revolutions/minute.

In an embodiment, the throwing speed is controlled to be 18 m/s to 19 m/s, and the throwing angle is controlled to be 15 degrees.

In an embodiment, the radius of a snow removing head is 0.088 m, and a rotational speed is controlled to be 1800 revolutions/minute to 2000 revolutions/minute.

In an embodiment, the throwing angle is controlled to be negative, and the initial height is controlled to be less than or equal to 1 meter.

In an embodiment, the automatic snow removal device further comprising simultaneously controlling a snow throwing distance to satisfy a predetermined requirement.

In an embodiment, the snow throwing mechanism comprises a snow removing head rotating around a central axis, and the working motor drives the snow removing head to rotate to collect accumulated snow and miscellaneous matter on the ground into the snow throwing mechanism, wherein the initial height and the radius of the snow removing head are given, and a rotational speed of the snow removing head and/or the throwing angle are controlled to control the snow throwing height.

In an embodiment, the throwing angle is further given, and the rotational speed of the snow removing head is controlled to control the snow throwing height.

In an embodiment, the automatic snow removal device further comprising: a snow-removing-head rotational-speed detection component, configured to detect the rotational speed of the snow removing head, wherein when the rotational speed of the snow removing head is greater than a first predetermined rotational speed threshold, the control module performs control to enable the throwing angle of the thrown object to be a first angle.

In an embodiment, the rotational speed of the snow removing head is greater than a second predetermined rotational speed threshold, the control module performs control to enable the throwing angle of the thrown object to be a second angle, wherein the second predetermined rotational speed threshold is less than the first predetermined rotational speed threshold, and the second angle is greater than the first angle.

In an embodiment, the automatic snow removal device further comprising: a throwing angle detection component, configured to detect the throwing angle, wherein when the throwing angle is greater than a first predetermined angle threshold, the control module performs control to enable the rotational speed of the snow removing head to be a first rotational speed.

In an embodiment, when the throwing angle is greater than a second predetermined angle threshold, the control module performs control to enable the rotational speed of the snow removing head to be a second rotational speed, wherein the second predetermined angle threshold is less than the first predetermined angle threshold, the second rotational speed is greater than the first rotational speed.

In an embodiment, the automatic snow removal device further comprising: increasing, based on environmental resistance, at least one of a rotational speed and the snow throwing angle that are determined for the snow throwing height without considering resistance.

In an embodiment, the automatic snow removal device further comprising: the snow throwing mechanism further comprises a snow thrower roller and a snow thrower cylinder, and the snow thrower roller provides the thrown object from the snow removing head with secondary power and throws the thrown object from the snow thrower cylinder.

In an embodiment, at least one of the rotational speed of the snow removing head, a rotational speed of the snow thrower roller, and the throwing angle is controlled to control the snow throwing height.

In an embodiment, the automatic snow removal device further comprising: a baffle structure, disposed at an end portion of the snow throwing mechanism, wherein a baffle angle is adjustable, and the baffle angle can be adjusted to adjust the throwing angle.

In an embodiment, the control module adjusts the speed of the moving module according to the thickness of snow to enable the snow throwing height to be not greater than the predetermined snow throwing height threshold.

In an embodiment, when the thickness of snow is less than 4 cm, the control module controls a moving speed of the moving module to be 20 m/min to 30 m/min.

In an embodiment, when the thickness of snow is greater than 4 cm, the control module controls a moving speed of the moving module to be 10 m/min to 25 m/min.

In an embodiment, the automatic snow removal device further comprising: a grating, disposed inside or at an end portion of the snow throwing mechanism, and configured to block miscellaneous matter to reduce miscellaneous matter in the thrown object.

In an embodiment, an interval of the grating is less than 50 mm.

In an embodiment, the snow throwing mechanism further comprises a snow thrower cylinder, and the snow thrower cylinder is rotatable in the horizontal direction.

In an embodiment, the automatic snow removal device further comprising: a pocket that is in the snow thrower cylinder and is provided with an air-permeable structure, and the air-permeable structure is made of an air-permeable material or is disposed as a mesh, so that the thrown object passes through the air-permeable structure to enter the pocket.

In an embodiment, the automatic snow removal device further comprising: a combination of the following throwing height control structure and/or thrown object energy control structure: a baffle structure, disposed at an end portion of the snow throwing mechanism, wherein a baffle angle is adjustable, and the baffle angle can be adjusted to adjust the throwing angle; a grating, disposed inside or at the end portion of the snow throwing mechanism, and configured to block miscellaneous matter to reduce miscellaneous matter in the thrown object; and a pocket having an air-permeable function or a porous structure.

The embodiments of the present invention further provide a safe snow throwing method for controlling a self-moving snow removal device to protect a human or an object from damage by snow or miscellaneous matter, wherein the self-moving snow removal device comprises a moving module, a working module, and a control module, and the safe snow throwing method comprises: driving, by the moving module, the snow removal device to move; driving, by a working motor, a snow throwing mechanism to collect accumulated snow and miscellaneous matter on the ground and throw the accumulated snow and miscellaneous matter out of the snow throwing mechanism, wherein a maximum height of a thrown object in the air from the ground is referred to as a snow throwing height; and controlling, by the control module, the working module or the moving module to enable the snow throwing height to be not greater than a predetermined snow throwing height threshold.

In an embodiment, the predetermined snow throwing height threshold is 0.8 meters to 1.1 meters.

In an embodiment, the predetermined snow throwing height threshold is 0.8 meters.

In an embodiment, the snow throwing mechanism comprises a snow removing head rotating around a central axis, and the working motor drives the snow removing head to rotate to collect accumulated snow and miscellaneous matter on the ground into the snow throwing mechanism, wherein the control module is configured to: when it is detected that a throwing speed reaches a predetermined speed threshold, control the snow throwing height to be not greater than the predetermined snow throwing height threshold.

In an embodiment, a value range of the predetermined speed threshold is 18 meter/second to 19 meter/second.

In an embodiment, the radius of the snow removing head is 0.088 meters, and a rotational speed of the snow removing head is 1800 revolutions/minute to 2000 revolutions/minute.

In an embodiment, a speed at which the snow throwing mechanism throws the thrown object is referred to as a throwing speed, an initial throwing angle relative to a horizontal direction is a throwing angle, and the height of a throwing point is an initial height, wherein at least one of the throwing speed, the throwing angle, and the initial height is controlled to control the snow throwing height.

In an embodiment, the radius of a snow removing head is 0.08 meters to 0.12 meters, a rotational speed of the snow removing head is 1500 revolutions/minute to 2500 revolutions/minute, and a value range of the predetermined snow throwing height threshold is 0.8 meters to 1.1 meters.

In an embodiment, the initial height is controlled to be 200 mm to 800 mm.

In an embodiment, the throwing speed is controlled to be 15 m/s to 20 m/s.

In an embodiment, the throwing angle is controlled to be −10 degrees to 25 degrees.

In an embodiment, the throwing speed is controlled to be 15 m/s to 20 m/s, and the throwing angle is controlled to be −10 degrees to 25 degrees.

In an embodiment, the throwing speed is controlled to be 15 m/s to 20 m/s, the throwing angle is controlled to be 0 degrees to 25 degrees, and the initial height is controlled to be 200 mm to 800 mm.

In an embodiment, the radius of a snow removing head is 0.08 m to 0.12 m, and a rotational speed of the snow removing head is controlled to be 1500 revolutions/minute to 2500 revolutions/minute.

In an embodiment, the throwing speed is controlled to be 18 m/s to 19 m/s, and the throwing angle is controlled to be 15 degrees.

In an embodiment, the radius of a snow removing head is 0.088 m, and a rotational speed is controlled to be 1800 revolutions/minute to 2000 revolutions/minute.

In an embodiment, the snow throwing angle is controlled to be negative, and the initial height is not greater than 1 meter.

In an embodiment, the safe snow throwing method further comprising simultaneously controlling a snow throwing distance to satisfy a predetermined requirement.

In an embodiment, the snow throwing mechanism comprises a snow removing head rotating around a central axis, and the working motor drives the snow removing head to rotate to collect accumulated snow and miscellaneous matter on the ground into the snow throwing mechanism, the initial height and the radius of the snow removing head are given, and a rotational speed of the snow removing head and/or the throwing angle are controlled to control the snow throwing height.

In an embodiment, the safe snow throwing method further comprising: detecting the rotational speed of the snow removing head by using the snow-removing-head rotational-speed detection component, and when the rotational speed of the snow removing head is greater than a first predetermined rotational speed threshold, performing, by the control module, control to enable the throwing angle of the thrown object to be a first angle.

In an embodiment, the safe snow throwing method further comprising: when the rotational speed of the snow removing head is greater than a second predetermined rotational speed threshold, performing, by the control module, control to enable the throwing angle of the thrown object to be a second angle, wherein the second predetermined rotational speed threshold is less than the first predetermined rotational speed threshold, and the second angle is greater than the first angle.

In an embodiment, the safe snow throwing method further comprising: detecting, by a throwing angle detection component, the throwing angle, and when the throwing angle is greater than a first predetermined angle threshold, performing, by the control module, control to enable the rotational speed of the snow removing head to be a first rotational speed.

In an embodiment, the safe snow throwing method further comprising: when the throwing angle is greater than a second predetermined angle threshold, performing, by the control module, control to enable the rotational speed of the snow removing head to be a second rotational speed, wherein the second predetermined angle threshold is less than the first predetermined angle threshold, and the second rotational speed is greater than the first rotational speed.

In an embodiment, the safe snow throwing method further comprising: further giving the throwing angle, and controlling the rotational speed of the snow removing head to control the snow throwing height.

In an embodiment, the snow throwing mechanism further comprises a snow thrower roller and a snow thrower cylinder, and the snow thrower roller provides the thrown object from the snow removing head with secondary power and throws the thrown object from the snow thrower cylinder, and at least one of the rotational speed of the snow removing head, a rotational speed of the snow thrower roller, and the throwing angle is controlled to control the snow throwing height.

In an embodiment, a baffle angle is adjusted to adjust the throwing angle, to adjust the snow throwing height, a baffle structure is disposed at an end portion of the snow throwing mechanism, and the baffle angle is adjustable.

In an embodiment, the control module adjusts the speed of the moving module according to the thickness of snow to enable the snow throwing height to be not greater than the predetermined snow throwing height threshold.

In an embodiment, when the thickness of snow is less than 4 cm, a moving speed of the moving module is controlled to be 20 m/min to 30 m/min.

In an embodiment, when the thickness of snow is greater than 4 cm, a moving speed of the moving module is controlled to be 10 m/min to 25 m/min.

In an embodiment, a grating disposed inside or at an end portion of the snow throwing mechanism is used to block some or all miscellaneous matter, to reduce miscellaneous matter in the thrown object.

In an embodiment, an interval of the grating is less than 50 mm.

In an embodiment, the snow throwing mechanism further comprises a snow thrower cylinder, and the snow thrower cylinder is rotatable in the horizontal direction.

In an embodiment, the safe snow throwing method further comprising: arranging a pocket provided with an air-permeable structure in the snow thrower cylinder, wherein the air-permeable structure is made of an air-permeable material or is disposed as a mesh, so that the thrown object passes through the air-permeable structure to enter the pocket.

In an embodiment, the safe snow throwing method further comprising controlling a throwing height and/or thrown object energy by using a combination of the following throwing height control structure and/or thrown object energy control structure: a baffle structure, disposed at an end portion of the snow throwing mechanism, wherein a baffle angle is adjustable, and the baffle angle can be adjusted to adjust the throwing angle; a grating, disposed inside or at the end portion of the snow throwing mechanism, and configured to block miscellaneous matter to reduce miscellaneous matter in the thrown object; and a pocket having an air-permeable function or a porous structure.

In an embodiment, the safe snow throwing method further comprising: increasing, based on environmental resistance, at least one of a rotational speed and the snow throwing angle that are determined for the snow throwing height without considering resistance.

The embodiments of present invention further provide a self-moving snow removal device protecting a human or an object from damage by thrown snow or miscellaneous matter, comprising: a moving module, driving the snow removal device to move; and a working module, comprising a working motor and a snow throwing mechanism driven by the working motor, wherein the snow throwing mechanism is driven by the working motor to collect accumulated snow and miscellaneous matter on the ground and throw the accumulated snow and miscellaneous matter out of the snow throwing mechanism, and a maximum height of a thrown object in the air from the ground is referred to as a snow throwing height, wherein the snow throwing height is not greater than a predetermined snow throwing height threshold.

In an embodiment, a speed at which the snow throwing mechanism throws the thrown object is referred to as a throwing speed, an initial throwing angle relative to a horizontal direction is a throwing angle, and the height of a throwing point is an initial height, wherein the initial height is not greater than the predetermined snow throwing height threshold.

In an embodiment, the automatic snow removal device further comprises a control module, and the control module is configured to control the working module or the moving module to enable the snow throwing height to be not greater than the predetermined snow throwing height threshold.

By means of the automatic snow removal device and the safe snow removal method provided in the embodiments of the present invention, a snow throwing height of a thrown object is controlled, to prevent the thrown object from hitting the face of a child or an adult, thereby improving a safety coefficient.

Furthermore, in addition to the control of the snow throwing height of the thrown object, any one or combination of a plurality of structures is arranged to control throwing energy of the thrown object, so that a child or an adult is protected from injury even when the thrown object hits the child or adult.

In view of the problem that a conventional outdoor high-voltage robot requires indoor high-voltage charging to satisfy a working requirement, the embodiments of the present invention provide a robot power supply apparatus and a robot.

A robot power supply apparatus includes a control circuit and a power supply module, where the power supply module is connected to the control circuit; the control circuit is configured to: when the robot is in a working state, control an output terminal of the power supply module to output a first voltage, and the control circuit is further configured to: when the robot is in a charging state, control the output terminal of the power supply module to output a second voltage; and the first voltage is higher than the corresponding second voltage after charging is completed.

In an embodiment, the power supply module includes two or more power supplies.

In an embodiment, the second voltage is an output voltage of the power supply.

In an embodiment, the second voltage is between 42 V and 60 V.

In an embodiment, the first voltage is a sum of output voltages of all the power supplies after charging is completed.

In an embodiment, the control circuit is configured to: when the robot is in a working state, control all the power supplies to be connected in series, and the control circuit is configured to: when the robot is in a charging state, control all the power supplies to be connected in parallel.

In an embodiment, the control circuit includes a control unit and a switch unit, where the control unit is configured to use the switch unit to control the power supplies to be connected in series or to be connected in parallel.

In an embodiment, a quantity of the power supplies is 2, and the power supplies are separately represented as a first power supply and a second power supply;

the switch unit includes a first single-pole double-throw switch and a second single-pole double-throw switch; a moving contact of the first single-pole double-throw switch is connected to a positive electrode of the first power supply, and a first fixed contact of the first single-pole double-throw switch is separately connected to a positive electrode of the second power supply and a second fixed contact of the second single-pole double-throw switch; and a moving contact of the second single-pole double-throw switch and a negative electrode of the first power supply are grounded together, and a first fixed contact of the second single-pole double-throw switch and a negative electrode of the second power supply are grounded together; and the control unit is configured to: when the robot is in a working state, control the moving contact of the first single-pole double-throw switch to be connected to the second fixed contact, and control the moving contact of the second single-pole double-throw switch to be connected to the second fixed contact; and the control unit is further configured to: when the robot is in a charging state, control the moving contact of the first single-pole double-throw switch to be connected to the first fixed contact, and control the moving contact of the second single-pole double-throw switch to be connected to the first fixed contact.

In an embodiment, the robot power supply apparatus further includes a switch circuit; the switch circuit is connected between the power supply module and a load in the robot, and is connected to the control circuit; when the robot is in a working state, the switch circuit is controlled by the control circuit to be in a conducting state; and when the robot is in a charging state, the switch circuit is controlled by the control circuit to be in an off state.

A robot includes a load and the foregoing robot power supply apparatus, where the load is connected to the robot power supply apparatus.

The robot power supply apparatus and the robot have the following beneficial effects: In the robot power supply apparatus and the robot, the control circuit is configured to: when the robot is in a working state, control an output terminal of the power supply module to output a first voltage, and the control circuit is further configured to: when the robot is in a charging state, control the output terminal of the power supply module to output a second voltage. Therefore, when the robot needs a relatively high working voltage, under the joint effect of the control circuit and the power supply module, even if an outdoor charger perform only low-voltage charging, the voltage the output terminal of the power supply module output by (that is, the first voltage) still satisfy a high power requirement, to overcome a disadvantage that a conventional outdoor high-voltage robot requires indoor high-voltage charging to satisfy a working requirement, thereby improving the level of intelligence of the robot.

BRIEF DESCRIPTION OF THE DRAWINGS

In the following detailed description of the embodiments of the present invention with reference to the accompanying drawings, these and/or other aspects and advantages of the embodiments of the present invention will become clearer and more comprehensible, where.

DETAILED DESCRIPTION

To make a person skilled in the art better understand the present invention, the present invention is further described below in detail with reference to the accompanying drawings and the specific implementations.

A self-moving snow removal device in a specific implementation of the present invention may be an automatic snow sweeper, an automatic snow thrower/lifter, an automatic snow pusher/shovel, a combination thereof or the like. The self-moving snow removal device automatically moves on the ground or surface in a working area to remove ice and snow, for example, sweep snow, throw snow or push snow, and may also be considered as a snow remover having an automatic working capability. The automatic working capability herein refers to that the snow remover performs snow removal without an operation by a user. The user does not need to keep remotely controlling the snow remover or keep monitoring the snow remover. The user only needs to complete related settings before the user switch to other work. The snow remover automatically executes a related program.

The automatic snow thrower, the automatic snow sweeper, and the automatic snow pusher are generally referred to as a snow remover herein.

Figure 1A:
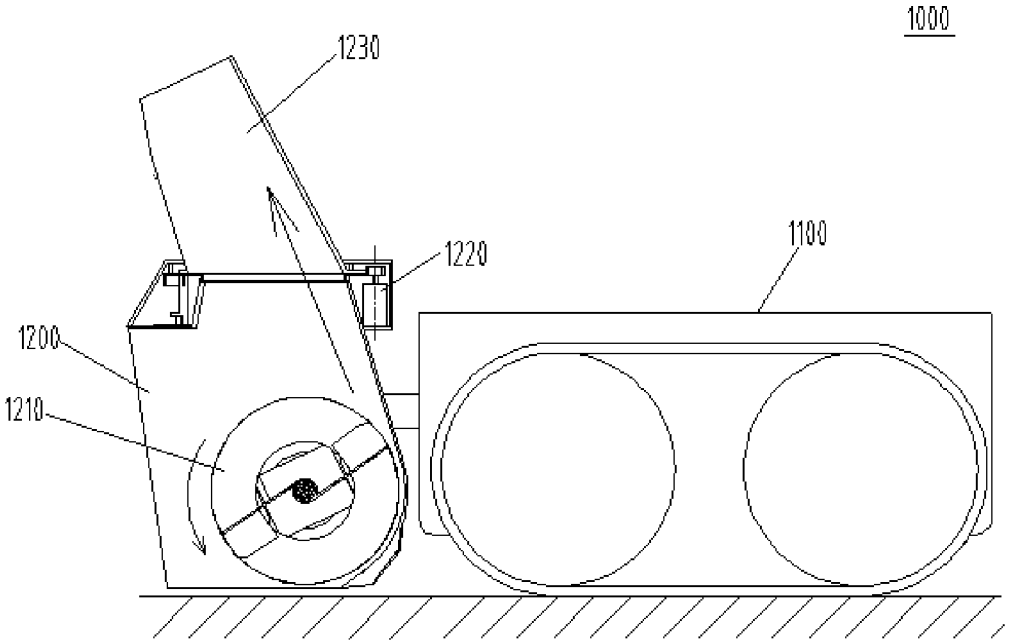
FIG. 1(*a*) is a schematic diagram of a simplified structure 1000 of a self-moving snow removal device according to a first embodiment of the present invention, and FIG. 1(*b*) is a schematic diagram of a simplified structure 1000' of a self-moving snow removal device according to a second embodiment of the present invention.
Figure 1B:
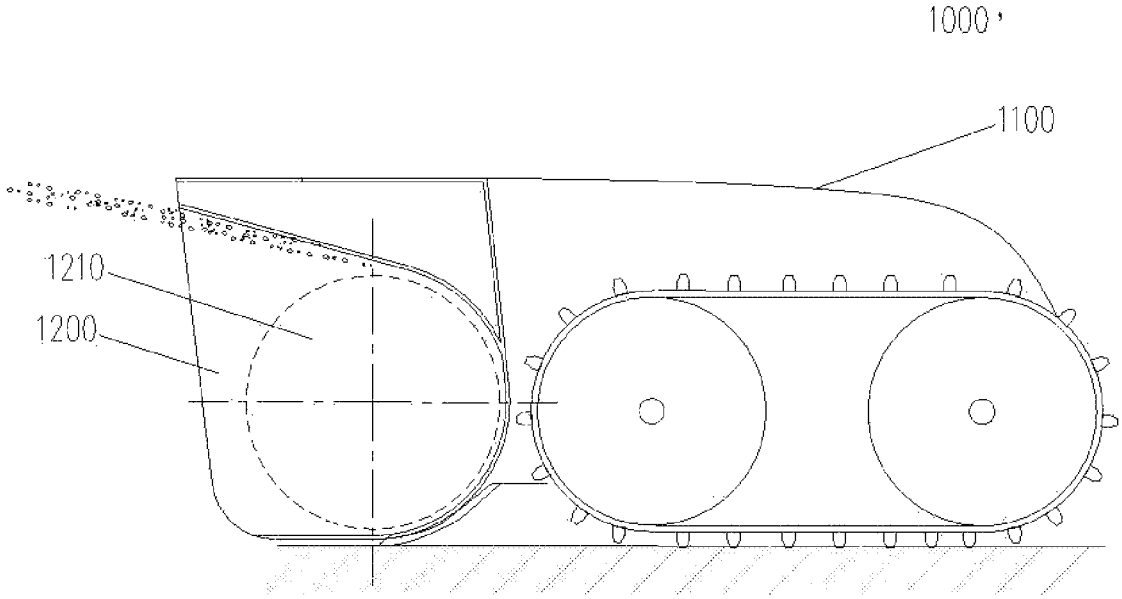

FIG. 1(*a*) is a schematic diagram of a simplified structure 1000 of a self-moving snow removal device according to a first embodiment of the present invention. The self-moving snow removal device includes a snow thrower cylinder. FIG. 1(*b*) is a schematic diagram of a simplified structure 1000' of a self-moving snow removal device according to a second embodiment of the present invention. The self-moving snow removal device does not include a snow thrower cylinder.

As shown in FIG. 1(*a*), the self-moving snow removal device 1000 includes a main unit 1100 and a snow throwing mechanism 1200. Certainly, the self-moving snow removal device 1000 further includes a working motor driving the snow throwing mechanism 1200 to work and the like, which are not described herein to avoid confusion of key points.

The snow throwing mechanism 1200 includes a snow removing head 1210, a snow thrower cylinder 1230, a snow-thrower-cylinder turning motor and mechanism 1220. A specific example of the snow removing head 1210 is, for example, a snow shovel or an auger or a rubber roller brush. By way of example rather than limitation, an auger is used as an example for description below.

The snow removing head 1210 is used as a snow scraping component and rotates around a central axis. The working motor drives the auger to rotate to collect accumulated snow and miscellaneous matter on the ground into the snow throwing mechanism. The collected snow is then thrown out through the snow thrower cylinder under the effect of the snow-thrower-cylinder turning motor and mechanism 1230.

FIG. 1(*b*) is a schematic diagram of the self-moving snow removal device 1000' without a snow thrower cylinder. Compared with FIG. 1(*a*), the snow thrower cylinder 1230 and the snow-thrower-cylinder turning motor mechanism 1220 are omitted. The symbol S indicates a direct-throw snow throwing opening.

Figure 2:
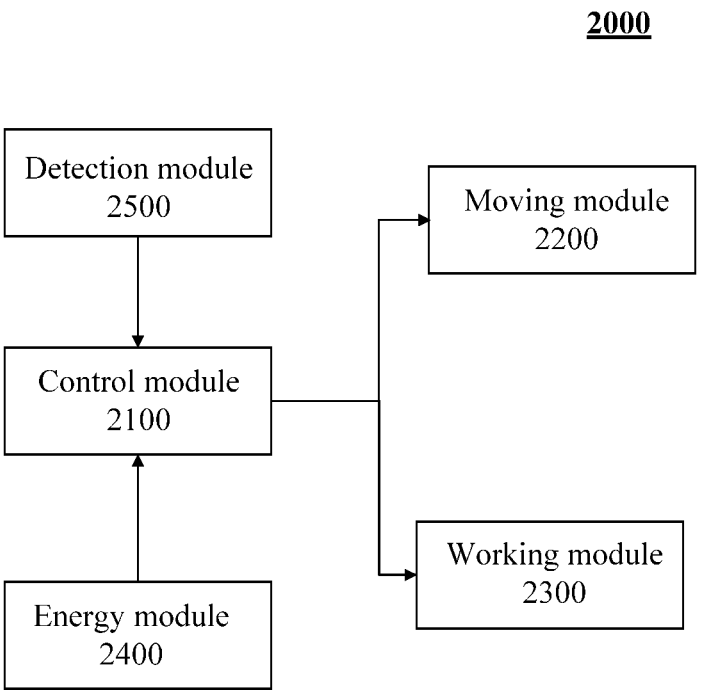
FIG. 2 is a schematic diagram of a system frame 2000 of a self-moving snow removal device.

FIG. 2 is a schematic diagram of a system frame 2000 of a self-moving snow removal device.

To avoid confusion of key points, the structures, operation modes, and functions related to the embodiments of the present invention are specially described herein. For the detailed structure and working principle, refer to the description in Chinese Patent Application No. CN201710065902.7.

FIG. 2 is a schematic diagram of functional modules of a self-moving snow removal device 2000 according to an embodiment of the present invention. The self-moving snow removal device 2000 includes a control module 2100, a moving module 2200, a working module 2300, an energy module 2400, a detection module 2500, and the like.

Specifically, the moving module 2200 drives the snow removal device to move.

The working module 2300 includes a working motor and a snow throwing mechanism driven by the working motor. The snow throwing mechanism is driven by the working motor to collect accumulated snow and miscellaneous matter on the ground and throw the accumulated snow and miscellaneous matter out of the snow throwing mechanism. A maximum height of a thrown object in the air from the ground is referred to as a snow throwing height.

The control module 2100 controls the working of the working module 2300. In an embodiment, the control module 2100 controls a rotational speed of the working motor of the working module 2300, so as to control a throwing speed of the thrown object, to further control the snow throwing height of the thrown object. In another embodiment, the control module 2100 controls a moving speed of the moving module 2200, so as to control the throwing speed of the thrown object.

A biggest difference between the self-moving snow removal device and a hand-propelled snow removal device lies in that the self-moving snow removal device is unsupervised during snow removal and snow throwing. In an unsupervised state, if the snow throwing height is excessively large, a human or an object is vulnerable to more severe damage. For a human, when the height is fixed, relatively strong organs such as legs are relatively low, and important organs such as the face are relatively high. If the snow throwing height is excessively large, the important organs such as the face are more vulnerable to injury. For an object, when the snow throwing height is larger, more objects are present below the snow throwing height, and an object is more likely to be hit. With supervision, an operator may automatically adjust a working state of the snow throwing mechanism according to the presence of a human or an object in the immediate environment. When there is no human or object in a snow throwing area, a snow throwing operation is performed, and there is no worry of causing damage to a human or an object by thrown snow. Once a human or an object is spotted in the snow throwing area, the snow throwing operation is paused immediately, thereby protecting the human or object from damage because the snow throwing height is excessively large. Therefore, it is highly necessary to consider restricting the snow throwing height below a predetermined snow throwing height threshold during the design of an unsupervised self-moving snow removal device.

The developers have carried out long-time research on typical snow working environment, combined that an actual application scenario of the automatic snow removal device is a front yard and a back yard of a residence, and considered the height of a human or an object that appears in a front yard and a back yard of a residence. In one embodiment, the predetermined snow throwing height threshold is set to a value between 0.8 meters and 1.1 meters. A case in which a front yard and a back yard of a residence are completely covered in accumulated snow is further considered, and a child playing on the snow is about 3 years old. To prevent a thrown object from hitting the face or above of a child who is three or older or an adult. In one embodiment, the predetermined snow throwing height threshold is set to 0.8 meters.

To facilitate thorough understanding of the embodiments of the present invention by a person skilled in the art, the technical principle and theoretical analysis of controlling a snow throwing height of a self-moving snow removal device according to an embodiment of the present invention are described below.

In an intelligent unmanned snow-throwing snow sweeper, a working head auger is powered by a motor, the auger rotates to pull in accumulated snow, the accumulated snow is then thrown by blades of the auger or a fan, and a snow throwing apparatus throws the collected accumulated snow to one side of a road or a specific place. During snow throwing, a hard object such as a cobblestone on the road may be thrown with the snow and has particular energy (lift). If a cobblestone or another hard object in a thrown object has excessively high energy, a human, a pet or another article may be vulnerable to damage. Therefore, the energy of the thrown object should be controlled within a particular range. To ensure the safety of a human and an object, in one embodiment, the snow throwing height needs to be controlled regardless of the energy of the thrown object. However, simplified control may be performed. For example, in a simplified example, when it is detected that the energy of the thrown object is excessively high, the snow throwing height may be automatically adjusted to enable the snow throwing height to be below a safe height.

Figure 3:
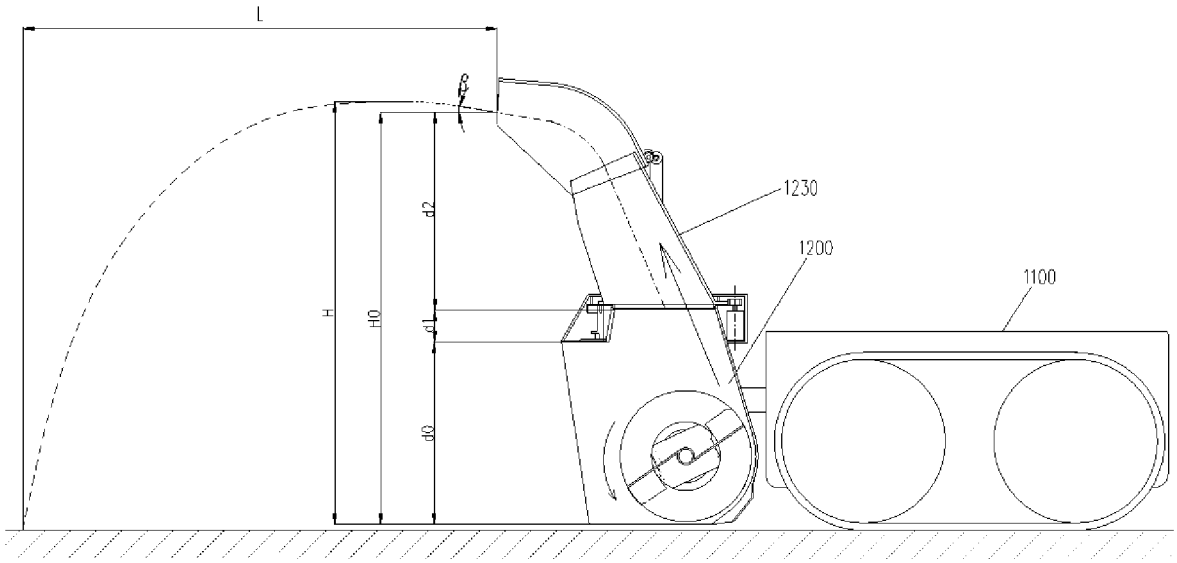
FIG. 3 is a schematic diagram of a theoretical basis of controlling a snow throwing height of a self-moving snow removal device according to an embodiment of the present invention.

FIG. 3 is a schematic diagram of a theoretical basis of controlling a snow throwing height of a self-moving snow removal device according to an embodiment of the present invention.

As shown in FIG. 3, snow and miscellaneous matter in the snow are thrown by the snow thrower cylinder 1230 from a throwing point A. The throwing point A herein is a point from which the snow leaves the snow thrower cylinder and is a central point at an end of the snow thrower cylinder herein. A throwing speed is represented by V. A throwing angle is represented by β. A nominal snow removing depth d. An initial height of throwing snow is $H_0$ and is the height of the throwing point from the ground herein. The snow throwing height is H. As discussed above, the snow throwing height is a maximum height of a thrown object in the air from the ground. A distance between horizontal projections of a landing point and the throwing point of the thrown object is a snow throwing distance and is represented by L. Influence factors of a snow throwing height H include the throwing speed V, the throwing angle β, and the initial height $H_0$. Therefore, the throwing speed V, the throwing angle β, and the initial height $H_0$ need to be designed and controlled, so as to ensure that the snow throwing height H is below a predetermined snow throwing height threshold. The predetermined snow throwing height threshold is 0.8 meters to 1.1 meters. How to design and control the foregoing influence factors is described below in detail.

Determination factors of the initial height $H_0$ include a nominal snow sweeping depth, a height at which snow needs to be accumulated during rise, and a height of a mechanism for guiding snow out of the self-moving snow removal device. In the embodiment shown in FIG. 3, the nominal snow sweeping depth is correspondingly do, the height at which snow needs to be accumulated during rise is correspondingly $d_1$, and the height of the mechanism for guiding snow out of the self-moving snow removal device is correspondingly a height $d_2$ of the snow thrower cylinder.

It is considered that the overall power of the self-moving snow removal device is approximately 1000 W, and is conventionally, for example, 500 W to 800 W or 1000 W to 1600 W. It is further considered that the watt-hour of an energy storage unit is approximately 300 Wh, and is conventionally, for example, 160 Wh, 200 Wh or 240 Wh. A configuration and the like are also considered. In this embodiment, the nominal snow sweeping depth do is 0 meters to 0.2 meters. The height $d_1$ at which snow needs to be accumulated during rise needs to ensure that thrown snow does not scatter. The height $d_2$ of the snow thrower cylinder corresponds to a height of an arc for ensuring that thrown snow has the lowest energy loss. The height of the arc affects the value of the throwing angle β. Different throwing angles β correspond to different heights $d_2$. In addition, the throwing angle β affects the snow throwing height H. In combination with various relevant factors, in an example, the initial height $H_0$ is set in a range of 200 mm to 800 mm.

Because the self-moving snow removal device of the embodiments of the present invention is mainly for domestic use, in consideration of that driveways of houses in the United States are generally within a width of 6 m, an example of parameter setting is that the snow throwing distance is 6 meters. Based on that the snow throwing distance is required to be 6 meters, the predetermined snow throwing height threshold is 0.8 meters to 1.1 meters, and the initial height $H_0$ is 200 mm to 800 mm. Various possible experiment modules are established, and repeated tests are carried out to obtain a series of values of the snow throwing speed V and the throwing angle β. Next, based on the product positioning of domestic self-moving snow removal devices, it is eventually determined that the snow throwing speed V=15 meter/second to 20 meter/second, and the throwing angle β=−10° to 25°. It should be noted that when the throwing angle is negative, the maximum height, that is, the snow throwing height, is determined by the initial height. In an example, the throwing angle of the automatic snow removal device is set to be negative, and the initial height is adjusted to adjust the maximum height.

Further, the snow throwing speed V is determined by the radius r of an auger and a rotational speed n of the auger. To simplify processing, the loss (the reduction of the rotational speed of the auger caused by a load is not considered) is not considered, and it may be considered that the throwing speed V and the radius r of the auger and the rotational speed n of the auger satisfy a relationship in the following formula: $v=2\pi rn$. Based on the snow throwing speed V=15 meter/second to 20 meter/second, in combination with the foregoing formula and the influence of the rotational speed n of the auger on the vibration and the influence of the radius of the auger on the overall size and the snow removing capability, it is set that n=1500 revolutions/minute to 2500 revolutions/minute and r=0.08 meters to 0.12 meters. A person skilled in the art may understand that the rotational speed n of the auger is actually obtained by controlling the rotational speed of a drive motor of the auger. In a scenario, mechanical transmission is provided between the auger and the drive motor. Therefore, the relationship between the rotational speed of the auger and the rotational speed of the drive motor depends on a transmission ratio of the mechanical transmission. In another scenario, no mechanical transmission is provided between the auger and the drive motor, and the auger is directly driven by the drive motor. Therefore, the rotational speed of the auger is the same as the rotational speed of the drive motor.

In an example, it is ensured that the snow throwing height is less than or equal to 1 meter, and some exemplary parameter configurations are shown in Table 1.

TABLE 1

| | | | | | | | | |
|---|---|---|---|---|---|---|---|---|
| Throwing angle β (degree) | 25 | 20 | 15 | 10 | 5 | 0 | −5 | −10 |
| Throwing speed V (meter/second) | 20 | 20 | 20 | 20 | 20 | 20 | 20 | 20 |
| Initial height $H_0$ (millimeter) | 280 | 400 | 520 | 630 | 720 | 1000 | 1000 | 1000 |

In one embodiment, the initial height in the automatic snow removal device in this embodiment of the present invention is controlled to be 200 millimeters to 800 millimeters. The throwing speed is controlled to be 15 m/s to 20 m/s, the throwing angle is controlled to be 0 degrees to 25 degrees, and the snow throwing height is controlled to be less than or equal to 1 meter.

In another example, it is ensured that the snow throwing height is less than or equal to 0.8 meters, and some exemplary parameter configurations are shown in Table 2.

TABLE 2

| | | | | | | | | |
|---|---|---|---|---|---|---|---|---|
| Throwing angle β (degree) | 25 | 20 | 15 | 10 | 5 | 0 | −5 | −10 |
| Throwing speed V (meter/second) | 20 | 20 | 20 | 20 | 20 | 20 | 20 | 20 |
| Initial height $H_0$ (millimeter) | 200 | 290 | 400 | 550 | 650 | 800 | 800 | 800 |

In another example, it is ensured that the snow throwing height is less than or equal to 0.8 meters, and some exemplary parameter configurations are shown in Table 3.

TABLE 3

| | | | | | | | | | |
|---|---|---|---|---|---|---|---|---|---|
| Snow throwing height H (m) | | | | | 0.8 | | | | |
| Initial snow throwing height $H_0$ (m) | 0.2 | 0.5 | 0.8 | 0.2 | 0.5 | 0.8 | 0.2 | 0.5 | 0.8 |
| Throwing snow speed V (m/s) | 15 | 15 | 15 | 18 | 18 | 18 | 20 | 20 | 20 |
| Snow throwing angle (degree) | 20.6 | 16.6 | 0.0 | 18.3 | 15 | 0.0 | 17.2 | 14.2 | 0.0 |

In one embodiment, the initial height in the automatic snow removal device in this embodiment of the present invention is controlled to be 200 millimeters to 800 millimeters. The throwing speed is controlled to be 18 m/s to 19 m/s, the throwing angle is controlled to be 10 degrees to 15 degrees, and the snow throwing height is controlled to be less than or equal to 0.8 meters. Correspondingly, n=1800 revolutions/minute to 2000 revolutions/minute, and r=0.088 meters.

In a scenario, the initial height $H_0$ and the radius r of the auger are given, and the control module 2100 controls at least one of the rotational speed of the auger or throwing angle, and the snow throwing height H is controlled not to exceed the predetermined snow throwing height threshold.

An exemplary method 400 for automatically controlling a snow throwing height is described below with reference to FIG. 4.

Step S410: A self-moving snow remover detects a rotational speed of an auger.

Step S420: A control module determines whether the rotational speed is greater than a first predetermined rotational speed threshold. When the determination result is yes, the process turns to step S430, or otherwise the process turns to step S440.

Step S430: The control module performs control to enable a throwing angle to be a first angle.

Step S440: The control module determines whether the rotational speed is greater than a second predetermined rotational speed threshold, where the second predetermined rotational speed threshold is less than the first predetermined rotational speed threshold. When the determination result is yes, the process turns to step S450 in which the control module performs control to enable the throwing angle to be a second angle, or otherwise the process continues, to perform similar processing.

The rotational speed thresholds may be set in consideration of energy saving performance.

As can be seen from the foregoing analysis of a throwing height, when the rotational speed of the auger is higher, a throwing speed of a thrown object is higher, and the throwing height is larger. The throwing angle may be reduced to control the throwing height.

Figure 4:
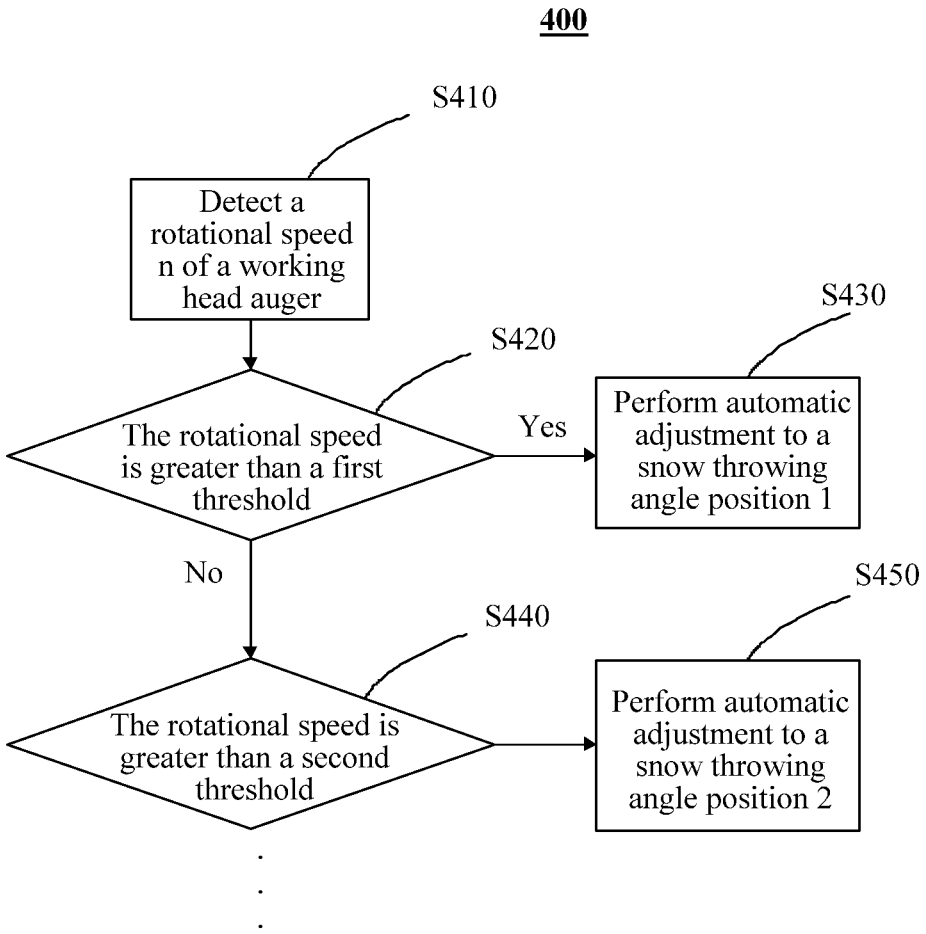
FIG. 4 is a flowchart of a method for detecting a rotational speed of an auger to control a throwing angle in order to control a throwing height.

FIG. 4 shows detection of the rotational speed of the auger to control the throwing angle in order to control the throwing height. In contrast, the throwing angle may be detected to control the rotational speed of the auger in order to control the throwing height.

Figure 5:
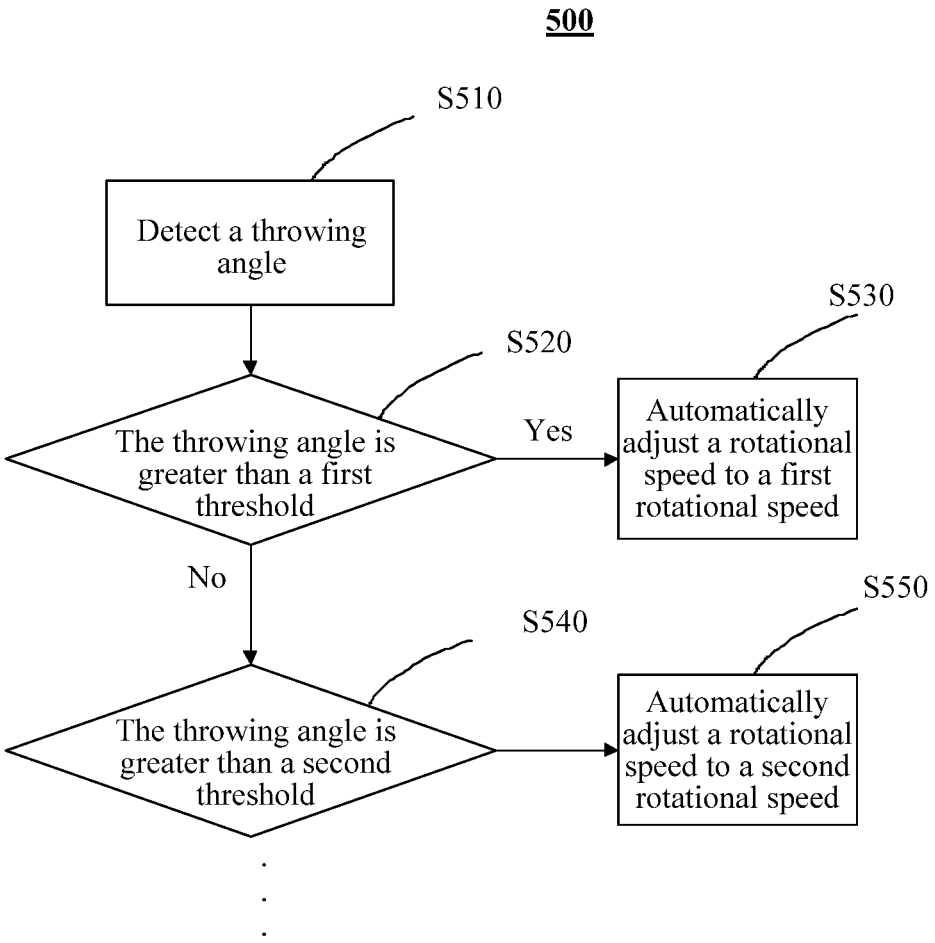
FIG. 5 is a flowchart of a method for detecting a throwing angle to control a rotational speed of an auger in order to control a throwing height.

FIG. 5 is a flowchart of a method for detecting a throwing angle to control a rotational speed of an auger in order to control a throwing height.

Specifically, the automatic snow removal device further includes a throwing angle detection component, configured to detect a throwing angle. In the method for detecting a throwing angle by the throwing angle detection component, the throwing angle may be directly detected, or another indirect parameter may be detected and conversion is performed to obtain the throwing angle.

As shown in FIG. 5: Step S510: Detect a throwing angle.

Step S520: Determine whether the throwing angle is greater than a first predetermined angle threshold. If the result is yes, the process turns to step S530, or otherwise the process turns to step S540.

Step S530: A control module performs control to enable the rotational speed of the auger to be a first rotational speed.

Step S540: Determine whether the throwing angle is greater than a second predetermined angle threshold. If the result is yes, the process turns to step S550 in which the control module performs control to enable the rotational speed of the auger to be a second rotational speed, where the second predetermined angle threshold is less than the first predetermined angle threshold, and the second rotational speed is greater than the first rotational speed. If the determination result of step S540 is no, the foregoing operation may continue to be performed.

FIG. 5 shows a method in which when a throwing angle is adjustable, the throwing angle is detected, and a rotational speed of an auger is controlled based on the detected throwing angle to control the throwing height.

In another example, the initial height $H_0$, the radius r of the auger, and the throwing angle are kept constant, and the rotational speed is controlled to control the height. In a very specific scenario, it is given that the initial height $H_0$=0.6 meters, the throwing angle=15 degrees, and the radius r of the auger=0.088 meters. To control a snow throwing height to be less than 1 meter, the rotational speed of the auger may be controlled not to exceed 2200 revolutions/minute, to prevent a throwing speed from exceeding 20 m/s, so as to satisfy the requirement of controlling the snow throwing height to be 1 meter or less. To control the snow throwing height to be less than 0.8 meters, the rotational speed of the auger may be controlled not to exceed 1750 revolutions/minute, to prevent the throwing speed from exceeding 16 m/s, thereby satisfying the requirement of controlling the snow throwing height to be 0.8 meters or less. Various values in Table 4 may be specifically as follows:

TABLE 4

| | | | | | | |
|---|---|---|---|---|---|---|
| Snow throwing height H (m) | 0.75 | 0.8 | 0.85 | 0.9 | 0.95 | 1 |
| Throwing speed V (m/s) | 15 | 16 | 17 | 18 | 19 | 20 |
| Throwing angle (degree) | | | 15 | | | |
| Initial snow throwing height $H_0$ (m) | | | 0.6 | | | |

When the throwing angle, the radius of the auger, and the initial snow throwing height are kept constant, the design and manufacturing costs of the automatic snow removal device are reduced, thereby providing an economical and practical implementation.

In the foregoing method for controlling a snow throwing height, environmental resistance is not considered. In real life, there may be obvious environmental resistance such as wind resistance. In this case, with such resistance, because the rotational speed of the auger and the throwing angle are determined without considering resistance, the reached snow throwing height is less than the snow throwing height under ideal conditions. Therefore, environmental resistance may be evaluated, and at least one of the rotational speed and the throwing angle that are determined for the snow throwing height without considering resistance is increased.

In an exemplary automatic snow removal device, the snow throwing mechanism further includes a snow thrower roller and a snow thrower cylinder. The snow thrower roller provides a thrown object from the auger with secondary power and throws the thrown object from the snow thrower cylinder. In this case, the speed of the thrown object thrown from the snow thrower cylinder is mainly determined by the rotational speed of the auger and a rotational speed of the snow thrower roller.

Therefore, in an example, at least one of the rotational speed of the auger, the rotational speed of the snow thrower roller, and the throwing angle is controlled to control the snow throwing height.

In another example, the snow throwing height is completely restricted below a predetermined snow throwing height threshold with the given initial height $H_0$ and the throwing angle. In this case, a control module does not need to control the snow throwing speed or a rotational speed of the drive motor of the snow removing head. When the predetermined snow throwing height threshold is 0.8 meters, the given initial height $H_0$ and the throwing angle may have the values in Table 5 below. In this case, regardless of the value of the snow throwing speed, the snow throwing height does not exceed 0.8 meters.

TABLE 5

| | | | | | | | | | | |
|---|---|---|---|---|---|---|---|---|---|---|
| Snow throwing height H (m) | 0.65 | 0.7 | 0.75 | 0.8 | 0.5 | 0.5 | 0.5 | 0.5 | 0.5 | 0.5 |
| Initial snow throwing height $H_0$ (m) | 0.5 | | | | 0.5 | | | | | |
| Throwing snow speed V (m/s) | 15 | 16 | 17 | 18 | 15 | 16 | 17 | 18 | 19 | 20 |
| Snow throwing angle (degree) | 15.0 | | | | 0.0 | | | | | |

The automatic snow removal device according to the foregoing embodiments of the present invention controls the snow throwing height to enable the snow throwing height to be less than a predetermined threshold, so as to reduce or even eliminate the potential risk of throwing a thrown object at the face of a child or the like, thereby improving the safety of snow throwing.

In another specific embodiment, a moving speed V1 of the moving module 2200 also affects the snow throwing height H. The moving speed V1 of the moving module 2200 is controlled to enable the snow throwing height H to be not greater than the predetermined snow throwing height threshold. In a case, the thickness of snow is combined to adjust the moving speed V1 of the moving module 2200. For example, when the thickness of snow is relatively larger, if the moving module 2200 moves fast, the snow removing head 1210 of the snow throwing mechanism 1200 collects a relatively large amount of snow. The amount of snow thrown by the snow thrower cylinder 1220 is less than the amount of collected snow, and as a result snow is stuck in the snow throwing mechanism 1200. Therefore, when the thickness of snow is relatively large, the moving speed V1 of the moving module 2200 is correspondingly reduced, thereby improving the snow processing capability of the snow throwing mechanism 1200. When the thickness of snow is relatively small, the moving speed V1 of the moving module 2200 is correspondingly increased, so that a snow throwing distance is increased, thereby improving the snow throwing capability of the snow throwing mechanism 1200. Further, in consideration of the relationship between the foregoing factor and the snow throwing height H, in a specific embodiment, when the thickness of snow is less than 4 cm, the moving speed V1 of the moving module 2200 is controlled to be 20 m/min to 30 m/min. When the thickness is greater than 4 cm, the moving speed V1 of the moving module 2200 is controlled to be 10 m/min to 25 m/min.

According to some other embodiments of the present invention, an automatic snow removal device is provided, both a snow throwing height and throwing energy of a thrown object are controlled to protect a child or an adult from injury. There are a plurality of methods for controlling the throwing energy of the thrown object. For example, a running parameter of a snow throwing mechanism is controlled or any one or combination of a plurality of structures is arranged to control the throwing energy of the thrown object.

In an example, the running parameter of the snow throwing mechanism is controlled to control the throwing energy of the thrown object to be less than safe energy. Refer to the description in Chinese Patent Application CN201710065902.7 for the meaning of safe energy. Specifically, the running parameter of the snow throwing mechanism may be used to enable a throwing speed of the thrown object to be 18.5 m/s±1 m/s. According to $v=2\pi rn$, correspondingly, it is given that the radius of an auger is 0.088 m±0.01 m, and a rotational speed of the auger is controlled to be 1800 revolutions/minute to 2000 revolutions/minute.

Figure 9:
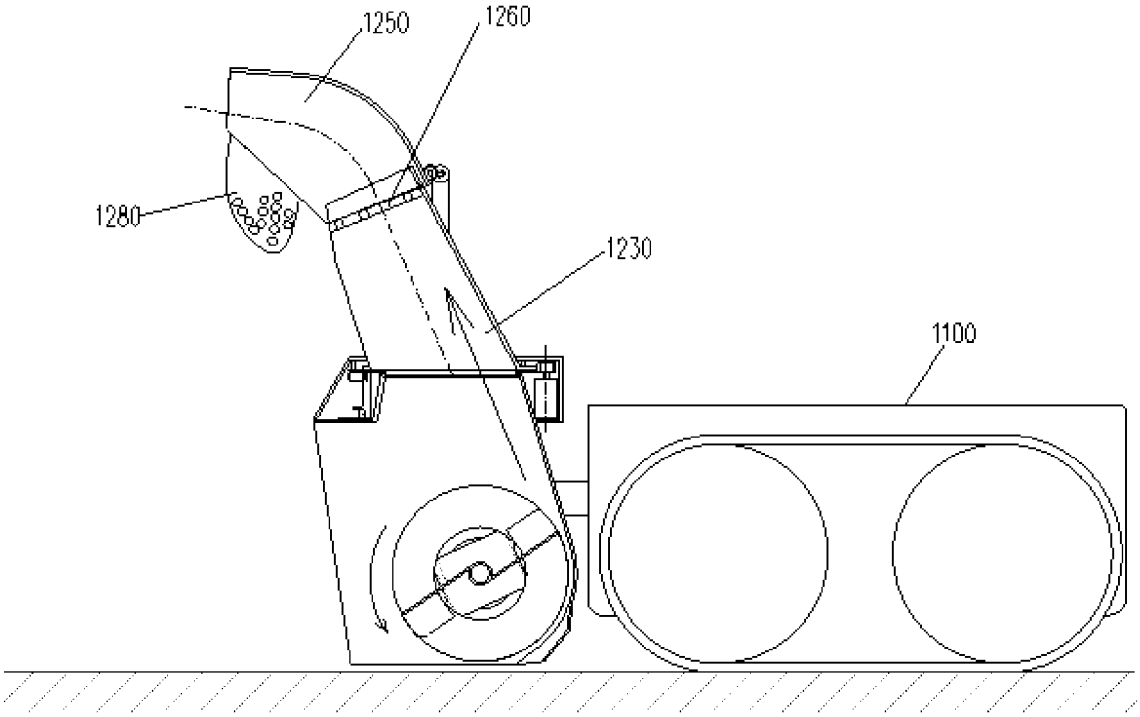
FIG. 9 is a schematic structural diagram of an automatic snow removal device configured with a pocket structure according to an embodiment of the present invention.
Figure 10:
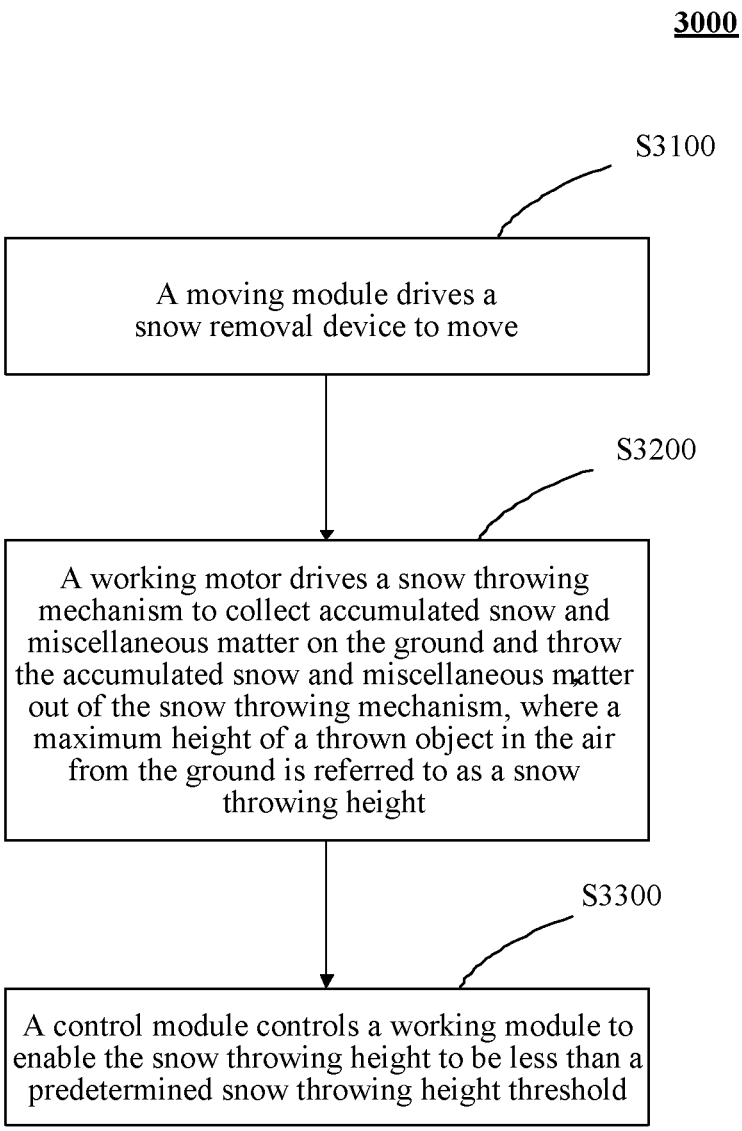
FIG. 10 is a flowchart of an exemplary method for automatically controlling a snow throwing height of a self-moving snow removal device according to an embodiment of the present invention.

An exemplary technical solution of controlling both the snow throwing height and the throwing energy of the thrown object according to an embodiment of the present invention is described below with reference to FIG. 6 to FIG. 9. For example, a baffle structure shown in FIG. 6 and the bent structure shown in FIG. 9 are used to control the height and also control energy. For example, a grating shown in FIG. 7 and the pocket shown in FIG. 10 are used to control energy and also control height. In an example, in the automatic snow removal device, the baffle structure and/or the bent structure is disposed, and the grating and/or the pocket is disposed as required to control the snow throwing height and the snow throwing energy.

According to an embodiment of the present invention, the automatic snow removal device further includes a baffle structure, disposed at an end portion of the snow throwing mechanism. A baffle angle is adjustable, and the baffle angle is adjusted to adjust a throwing angle. Exemplary description is provided below with reference to FIG. 6.

Figure 6:
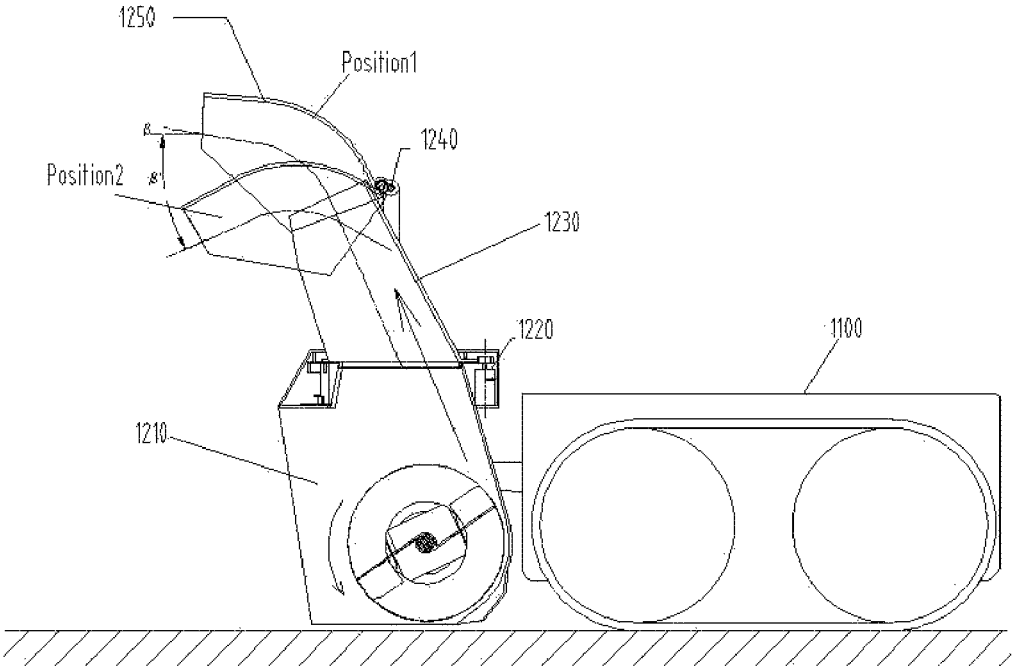
FIG. 6 is a schematic structural diagram of an automatic snow removal device provided with a baffle structure according to an embodiment of the present invention.

FIG. 6 shows an automatic snow removal device according to an embodiment of the present invention. A safe flow guide plate (also referred to as a baffle structure herein, where the two names are interchangeable) 1250 is provided at an end portion (an end portion of the snow thrower cylinder 1230 in the figure) of a snow throwing mechanism. An angle of the safe flow guide plate 1250 may be adjusted by, for example, a safe-flow-guide turning motor and mechanism 1240.

A baffle angle may be controlled in association with a rotational speed of a working auger 1210 to control the height and energy of a thrown object. For example, when the rotational speed of the working auger 1210 is excessively high and as a result the thrown object has a relatively high throwing height and relatively high energy, the angle of the safe flow guide plate 1250 may be reduced. In this way, the throwing height is reduced, and the energy of the thrown object is reduced at the same time.

The baffle structure with an adjustable angle relative to the end portion of the snow throwing mechanism is disposed, so that the throwing height of snow is adjusted and snow is blocked to cause loss to the energy of the thrown object, thereby improving safety performance.

According to another embodiment of the present invention, the automatic snow removal device further includes a grating, disposed inside or at the end portion of the snow throwing mechanism, and configured to block miscellaneous matter, to reduce miscellaneous matter in the thrown object, and a blocked miscellaneous object may be, for example, collected in the form of a string pocket. The structure of the grating is schematically described below with reference to FIG. 7.

Figure 7:
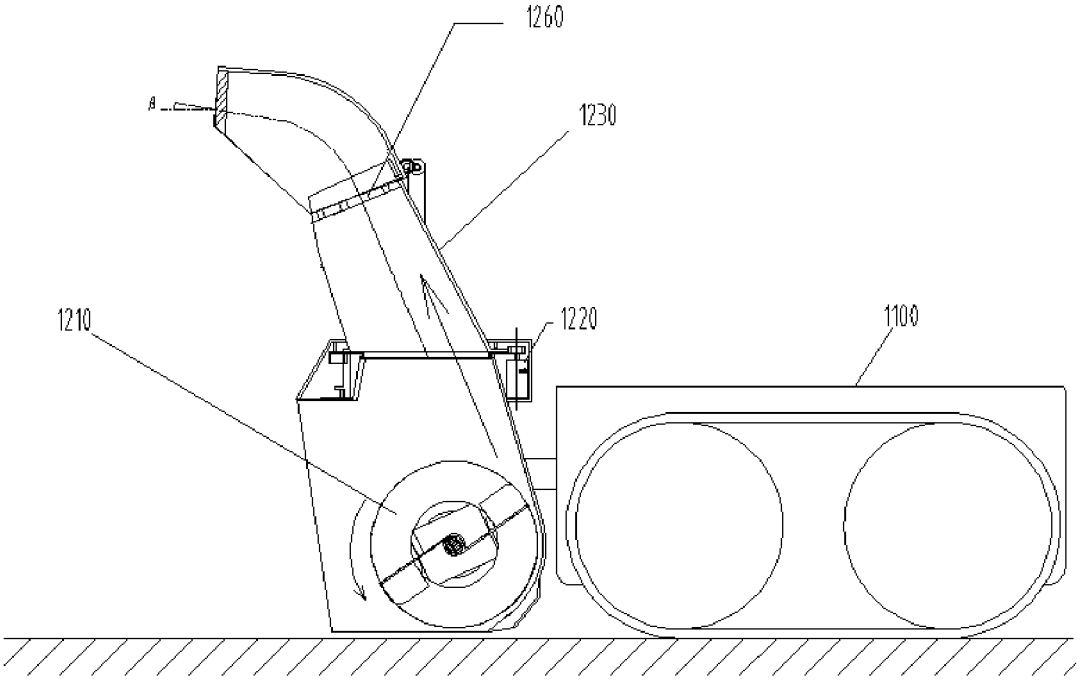
FIG. 7 is a schematic structural diagram of an automatic snow removal device provided with a grating according to an embodiment of the present invention.
Figure 8A:
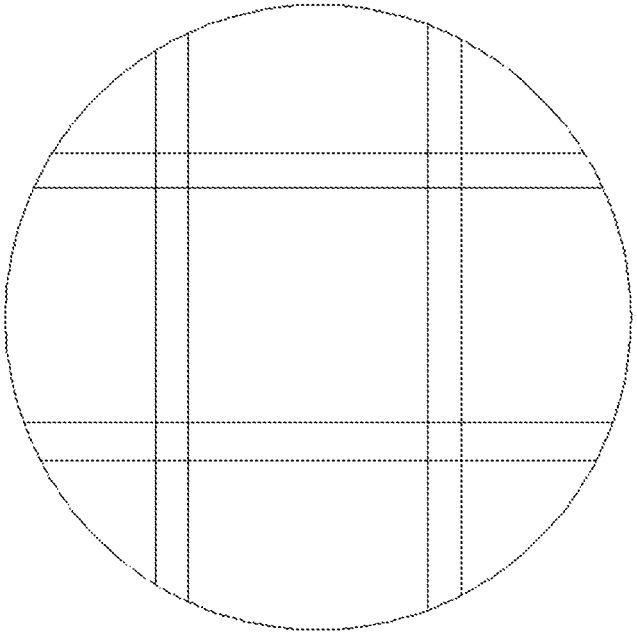
FIG. 8(*a*) to FIG. 8(*e*) are exemplary schematic structural diagrams of a grating.
Figure 8B:
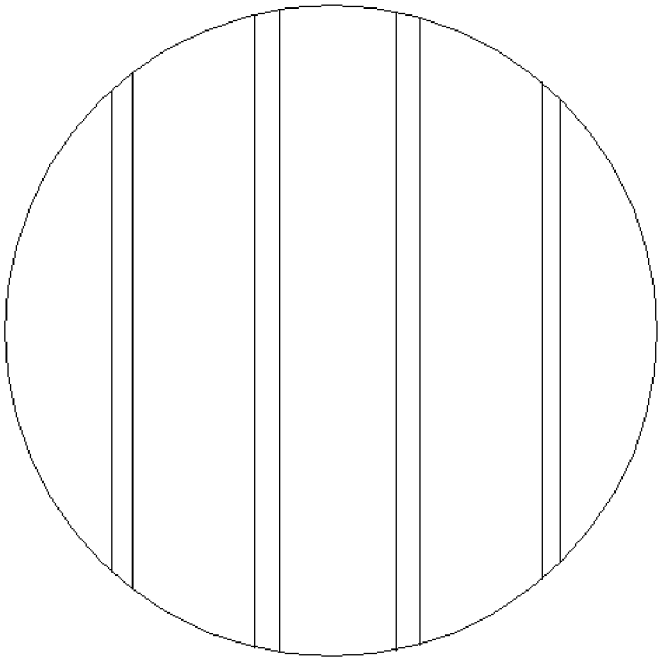
Figure 8C:
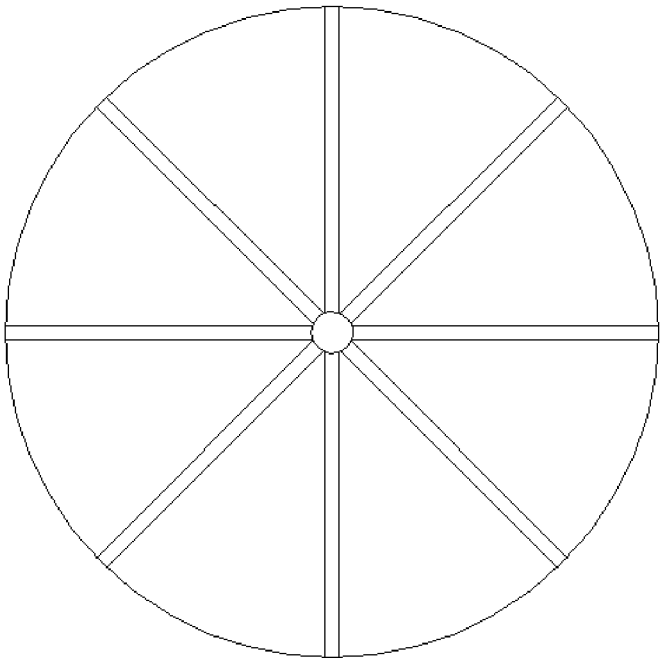
Figure 8D:
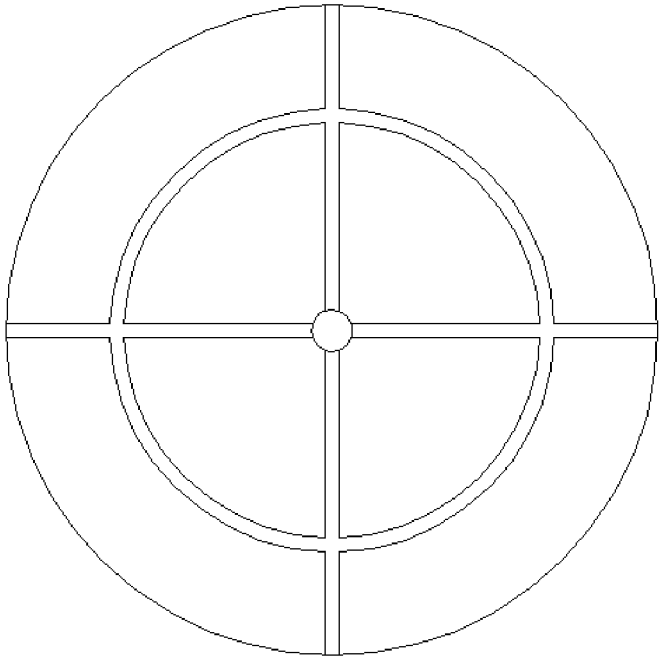
Figure 8E:
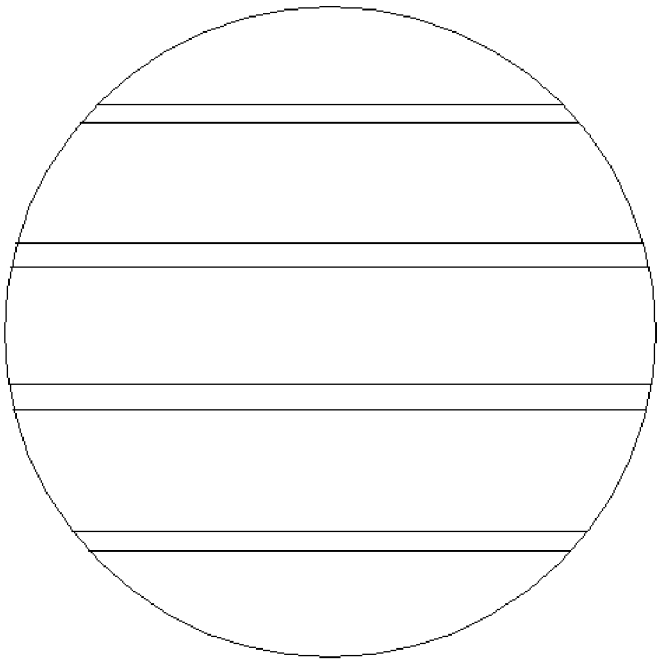

FIG. 7 shows an automatic snow removal device according to another embodiment of the present invention. A grating 1260 is provided at an end portion (an end portion of the snow thrower cylinder 1230 in the figure) of a snow throwing mechanism. FIG. 8(*a*) to FIG. 8(*e*) are several exemplary schematic structural diagrams of a grating.

According to another embodiment of the present invention, the automatic snow removal device further includes a pocket that is in the snow thrower cylinder and is provided with an air-permeable structure. The air-permeable structure is made of an air-permeable material or is disposed as a mesh, so that a thrown object passes through the air-permeable structure to enter the pocket. Exemplary description is provided below with reference to FIG. 9.

FIG. 9 shows an automatic snow removal device according to another embodiment of the present invention. The automatic snow removal device is provided with a pocket 1280 configured to collect a hard object, so as to further reduce the danger of injuring a human by the hard object in a thrown object.

The pocket 1280 is air-permeable or provided with holes. In this way, for example, a hard object such as a cobblestone pass through the pocket.

In the example shown in FIG. 9, an end portion of the snow thrower cylinder 1230 is provided with the safe flow guide plate 1250. The grating 1260 is provided in a snow throwing mechanism. The safe flow guide plate 1250 on the snow thrower cylinder 1230 or the grating blocks a hard object, so as to reduce throwing energy of the hard object. The air-permeable pocket 1280 may further collect a hard object. The collected hard object directly falls in the pocket, so that the hard object is prevented from being thrown out, thereby protecting a human or the object from injury.

It may be seen that the structural combination shown in FIG. 9 includes the safe flow guide plate 1250, the grating 1260, and the pocket 1280, so that the energy loss of the thrown object is reduced, thereby ensuring a low throwing height satisfying safety requirements, so that miscellaneous matter with relatively large size is prevented from being thrown, and the hard object is collected, to provide relatively complete safety guarantee.

Various combinations and modification may be made as required to the grating, the bent structure, and the pocket shown in FIG. 6 to FIG. 9 by a person skilled in the art a baffle structure to adapt to actual cases, thereby satisfying safety requirements.

According to another embodiment of the present invention, a safe snow throwing method for controlling a self-moving snow removal device to protect a human or an object from damage by snow or miscellaneous matter is further provided. Description is provided below with reference to FIG. 10.

FIG. 10 is a general flowchart of a safe snow throwing method 3000 of controlling a self-moving snow removal device to protect a human or an object from damage by snow or miscellaneous matter according to an embodiment of the present invention.

As shown in FIG. 10: Step S3100: A moving module drives the snow removal device to move.

Step S3200: A working motor drives a snow throwing mechanism to collect accumulated snow and miscellaneous matter on the ground and throw the accumulated snow and miscellaneous matter out of the snow throwing mechanism, where a maximum height of a thrown object in the air from the ground is referred to as a snow throwing height.

Step S3300: A control module controls a working module to enable the snow throwing height to be less than a predetermined snow throwing height threshold.

In an example, the predetermined snow throwing height threshold is 0.8 meters to 1.1 meters.

In an example, the predetermined snow throwing height threshold is 0.8 meters.

In an example, the snow throwing mechanism includes a snow removing head rotating around a central axis, and the working motor drives the snow removing head to rotate to collect accumulated snow and miscellaneous matter on the ground into the snow throwing mechanism, where the control module is configured to: when it is detected that a throwing speed reaches a predetermined speed threshold, control the snow throwing height to be less than the predetermined snow throwing height threshold.

In an example, a value range of the predetermined speed threshold is 18 meter/second to 19 meter/second.

In an example, the radius of the snow removing head is 0.088 meters, and a rotational speed of the snow removing head is 1800 revolutions/minute to 2000 revolutions/minute.

In an example, a speed at which the snow throwing mechanism throws the thrown object is referred to as the throwing speed, an initial throwing angle relative to a horizontal direction is a throwing angle, and the height of a throwing point is an initial height, where at least one of the throwing speed, the throwing angle, and the initial height is controlled to control the snow throwing height, where when the throwing speed is higher, the snow throwing height is larger; if the throwing angle is controlled to be positive, when the throwing angle is larger, the snow throwing height is larger; and when the initial height is larger, the snow throwing height is larger.

In an example, the initial height is controlled to be 200 mm to 800 mm.

In an example, in the safe snow throwing method, the throwing speed is controlled to be 15 m/s to 20 m/s.

In an example, in the safe snow throwing method, the throwing angle is controlled to be −10 degrees to 25 degrees.

In an example, in the safe snow throwing method, the throwing speed is controlled to be 15 m/s to 20 m/s, and the throwing angle is controlled to be −10 degrees to 25 degrees.

In an example, in the safe snow throwing method, the throwing speed is controlled to be 15 m/s to 20 m/s, the throwing angle is controlled to be 0 degrees to 25 degrees, and the initial height is controlled to be 200 mm to 800 mm.

In an example, the radius of the snow removing head is 0.08 m to 0.12 m, and a rotational speed of the snow removing head is controlled to be 1500 revolutions/minute to 2500 revolutions/minute.

In an example, in the safe snow throwing method, the throwing speed is controlled to be 18 m/s to 19 m/s, and the throwing angle is controlled to be 15 degrees.

In an example, the radius of a snow removing head is 0.088 m, and the rotational speed is controlled to be 1800 revolutions/minute to 2000 revolutions/minute.

In an example, the safe snow throwing method the snow throwing angle is controlled to be negative, and the initial height is controlled to be less than or equal to 1 meter.

In an example, the safe snow throwing method further includes simultaneously controlling a snow throwing distance to satisfy a predetermined requirement.

In an example, the snow throwing mechanism includes an auger that rotates around the central axis, the working motor drives the auger to rotate to collect accumulated snow and miscellaneous matter on the ground into the snow throwing mechanism, where the initial height and the radius of the auger are given, and a rotational speed of the auger and/or the throwing angle of the thrown object is controlled to control the snow throwing height.

In an example, the safe snow throwing method further includes: detecting, by an auger rotational-speed detection component, the rotational speed of the auger, and controlling, by the control module, a drive motor of the auger according to the actual rotational speed of the auger, so that the rotational speed of the auger does not exceed a preset rotational speed threshold. In a method for detecting the rotational speed of the auger by using the auger rotational-speed detection component, the detection component may directly detect the rotational speed of the auger, or the detection component may directly detect the rotational speed of the drive motor of the auger, where a transmission ratio determined according to a transmission relationship between the auger and the working motor is used to calculate the rotational speed of the auger.

In an example, the safe snow throwing method further includes: detecting, by the auger rotational-speed detection component, the rotational speed of the auger, where when the rotational speed of the auger is greater than a first predetermined rotational speed threshold, the control module performs control to enable the throwing angle of the thrown object to be a first angle.

In an example, the safe snow throwing method further includes: when the rotational speed of the auger is greater than a second predetermined rotational speed threshold, performing, by the control module, control to enable the throwing angle of the thrown object to be a second angle, where the second predetermined rotational speed threshold is less than the first predetermined rotational speed threshold, and the second angle is greater than the first angle.

In an example, the safe snow throwing method further includes: detecting, by a throwing angle detection component, the throwing angle; and when the throwing angle is greater than a first predetermined angle threshold, performing, by the control module, control to enable the rotational speed of the auger to be a first rotational speed.

In an example, the safe snow throwing method further includes: when the throwing angle is greater than a second predetermined angle threshold, performing, by the control module, control to enable the rotational speed of the auger to be a second rotational speed, where the second predetermined angle threshold is less than the first predetermined angle threshold, and the second rotational speed is greater than the first rotational speed.

In an example, the snow throwing mechanism further includes a snow thrower roller and a snow thrower cylinder, the snow thrower roller provides the thrown object from the auger with secondary power and throws the thrown object from the snow thrower cylinder, and the safe snow throwing method further includes: controlling at least one of the rotational speed of the auger, the rotational speed of the snow thrower roller, and the throwing angle to control the snow throwing height.

In an example, the safe snow throwing method further includes: adjusting a baffle angle to adjust the throwing angle, to adjust the snow throwing height, where a baffle structure is disposed at an end portion of the snow throwing mechanism, and the baffle angle is adjustable.

In an example, the safe snow throwing method further includes: adjusting, by the control module, the speed of the moving module according to the thickness of snow to enable the snow throwing height to be not greater than the predetermined snow throwing height threshold.

In an example, the safe snow throwing method further includes: when the thickness of snow is less than 4 cm, controlling a moving speed of the moving module to be 20 m/min to 30 m/min.

In an example, the safe snow throwing method further includes: when the thickness of snow is greater than 4 cm, controlling a moving speed of the moving module to be 10 m/min to 25 m/min.

In an example, the safe snow throwing method further includes: using a grating disposed inside or at the end portion of the snow throwing mechanism to block some or all miscellaneous matter, to reduce miscellaneous matter in the thrown object.

In an example, an interval of the grating is less than 50 mm.

In an example, the safe snow throwing method may further include: arranging a pocket provided with an air-permeable structure in the snow thrower cylinder, where the air-permeable structure is made of an air-permeable material or is disposed as a mesh, so that the thrown object passes through the air-permeable structure to enter the pocket.

In an example, the safe snow removal method further includes controlling a throwing height and/or thrown object energy by using a combination of the following throwing height control structure and/or thrown object energy control structure: a baffle structure, disposed at the end portion of the snow throwing mechanism, a baffle angle is adjustable, and the baffle angle is adjusted to adjust the throwing angle; a grating, disposed inside or at the end portion of the snow throwing mechanism, and configured to block miscellaneous matter to reduce miscellaneous matter in the thrown object; and a pocket having an air-permeable function or a porous structure.

By means of the automatic snow removal device and the safe snow removal method according to the embodiments of the present invention, a snow throwing height of a thrown object is controlled, to prevent the thrown object from hitting the face of a child or an adult, thereby improving a safety coefficient.

Further, in addition to the control of the snow throwing height of the thrown object, any one or combination of a plurality of structures is arranged to control throwing energy of the thrown object, so that a child or an adult is protected from injury even when the thrown object hits the child or adult.

In the foregoing example, the relevant values such as an initial height, a target snow throwing height, and a throwing speed are chosen according to relatively small statistical heights of children, common depths of accumulated snow, and energy of the currently developed automatic snow removal device.

In a specific embodiment, a robot power supply apparatus is further provided and is configured to supply electrical energy to a load in a robot. In one embodiment, the robot is, for example, a moving robot that moves outdoors. For example, the robot is the self-moving snow removal device in the foregoing embodiment. The robot power supply apparatus is charged by using a charging device. For an outdoor charging device (for example, a charging post), a maximum output voltage is usually less than a working voltage required by the robot. That is, after the robot is charged in a conventional manner by using a charging device, a voltage obtained after charging is completed cannot satisfy the working voltage actually required by the robot.

Figure 11:
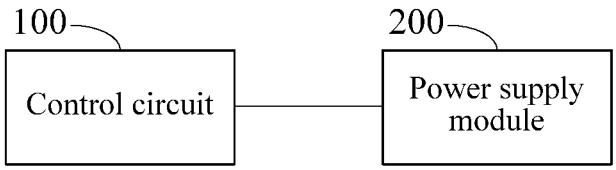
FIG. 11 is a block diagram of a robot power supply apparatus provided in an implementation.

Based on the foregoing case, an implementation provides a robot power supply apparatus. Referring to FIG. 11, the robot power supply apparatus includes a control circuit 100 and a power supply module 200. The power supply module 200 is connected to the control circuit 100. The power supply module 200 provide electrical energy.

The control circuit 100 is configured to: when the robot is in a working state, control an output terminal of the power supply module 200 to output a first voltage. The control circuit 100 is further configured to: when the robot is in a charging state, control the output terminal of the power supply module 200 to output a second voltage. The first voltage is higher than the corresponding second voltage after charging is completed.

The corresponding second voltage after charging is completed is a voltage output by the output terminal of the power supply module 200 after charging of the power supply module 200 is completed and before the robot enters a working state. Therefore, in this implementation, the voltage output by the power supply module 200 when the robot is working is different from that when the robot is being charged. That is, the power supply module 200 outputs a relatively high voltage when the robot is working, and outputs a relatively low voltage when the robot is being charged. Throughout the charging process (including the moment when the charging is completed), the voltage (that is, the second voltage) output by the power supply module 200 stays less than the corresponding voltage (that is, the first voltage) during working. Therefore, the robot use a high voltage during working, and the robot is charged by using a low voltage, to implement low-voltage charging and high-voltage working. Specifically, the control circuit 100 change a circuit connection principle in the power supply module 200 to change the voltage output by the output terminal of the power supply module 200.

In conclusion, when the robot needs a relatively high working voltage, under the joint effect of the control circuit 100 and the power supply module 200, even if an outdoor charger perform only low-voltage charging, the voltage (that is, the first voltage) output by the output terminal of the power supply module 200 still satisfy a high power requirement, to overcome a disadvantage that a conventional outdoor high-voltage robot requires indoor high-voltage charging to satisfy a working requirement, thereby improving the level of intelligence of the robot.

In an embodiment, the power supply module 200 includes two or more power supplies. The power supply is, for example, a storage battery, a lithium battery or another type of device that is charged and provide electrical energy.

Specifically, the second voltage is an output voltage of the power supply, and is, for example, between 42 V and 60 V.

Specifically, the first voltage is a sum of output voltages of all the power supplies after charging is completed. Therefore, as the robot is charged, the voltage output by the output terminal of the power supply module 200 is only an output voltage of a single power supply. As the robot works, the voltage output by the output terminal of the power supply module 200 is the sum of the output voltages of all the power supplies after charging is completed, so as to satisfy a high power requirement.

Further, the control circuit 100 is configured to: when the robot is in a working state, control all the power supplies to be serially connected. When all the power supplies are serially connected, a cathode of each power supply is connected to an anode of an adjacent power supply, and an anode of each power supply is connected to a cathode of another adjacent power supply. Therefore, after the control circuit 100 enables all the power supplies to be serially connected, the working voltage that is provided by the entire robot power supply apparatus to a load is a sum of power supply voltages of all the power supplies. Therefore, for a high-voltage robot, if a relatively high working voltage is required and the required working voltage is greater than a maximum voltage (that is, a voltage when charging is completed) that is provided by a single power supply, after all the power supplies are serially connected, the robot power supply apparatus provide a relatively high voltage, so as to satisfy a high power working requirement. Therefore, a power supply process provided in the implementation of the present invention is a high voltage working mode.

The control circuit 100 is further configured to: when the robot is in a charging state, control all the power supplies to be connected in parallel. In this case, each power supply is separately charged by using a charging device. Therefore, the charging process provided in this embodiment is low voltage charging, and charging is directly performed outdoors. Specifically, during charging, the charging device separately charge each power supply at the same time or sequentially charge the power supplies (that is, the charging device finishes charging one power supply and starts to charge a next power supply, and the process is repeated until all the power supplies have been charged).

Figure 12:
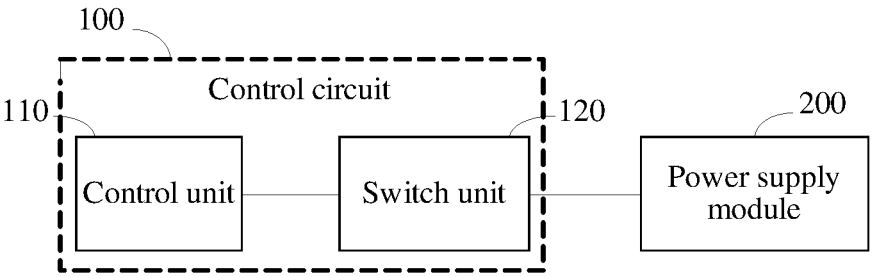
FIG. 12 is a block diagram of one of the embodiments of the robot power supply apparatus in the implementation shown in FIG. 11.

Specifically, referring to FIG. 12, the control circuit 100 includes a control unit 110 and a switch unit 120. The control unit 110 is configured to use the switch unit 120 to control the power supplies to be connected in series or to be connected in parallel. Therefore, the control unit 110 mainly controls the state of the switch unit 120, so as to enable the power supplies to be connected in series or to be connected in parallel. The control unit 110 is, for example, a programmable logic device or a hardware circuit formed by a plurality of devices.

Figure 13:
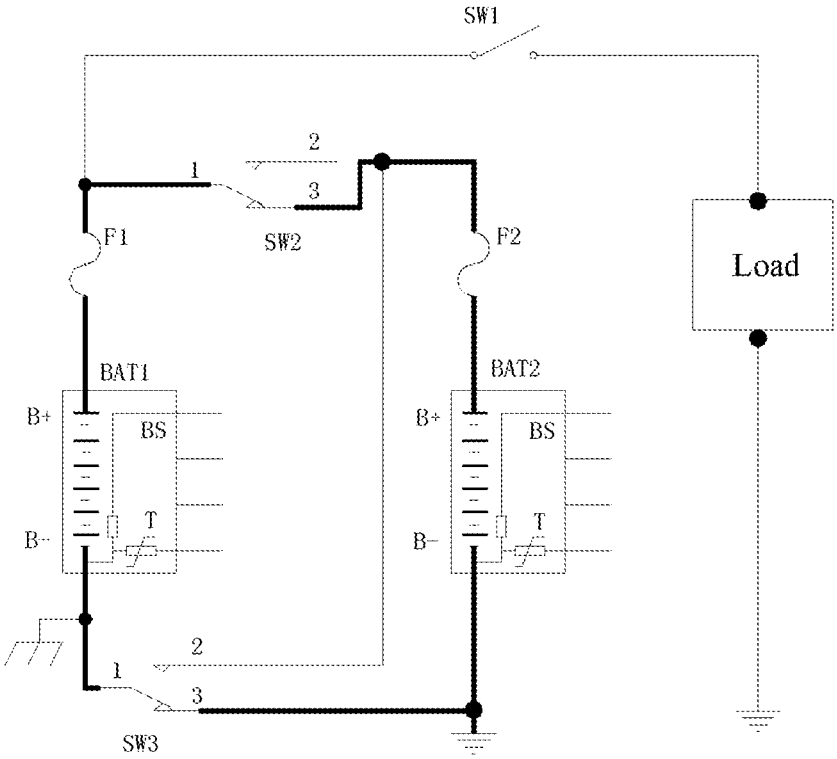
FIG. 13 is a schematic diagram of a charging circuit of one of the embodiments of the robot power supply apparatus in the implementation shown in FIG. 11.
Figure 14:
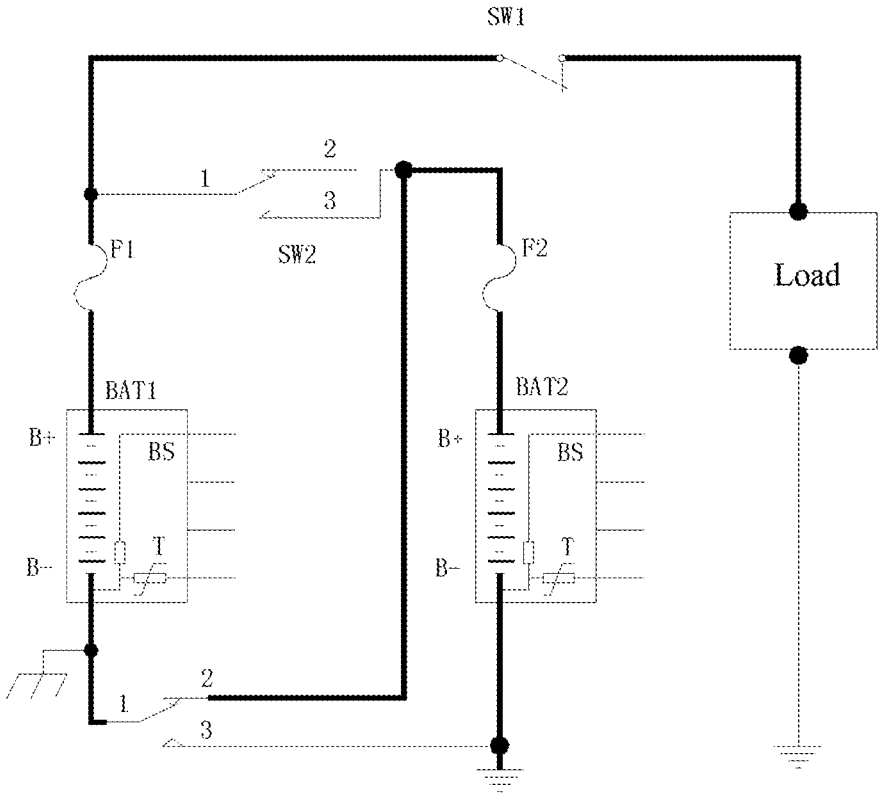
FIG. 14 is a schematic diagram of a power supply circuit of one of the embodiments of the robot power supply apparatus in the implementation shown in FIG. 11.

Specifically, referring to FIG. 13 and FIG. 14, a quantity of the power supplies is 2, and the power supplies are separately represented as a first power supply BAT1 and a second power supply BAT2. In addition, the switch unit 120 includes a first single-pole double-throw switch SW2 and a second single-pole double-throw switch SW3. A moving contact (1) of the first single-pole double-throw switch SW2 is connected to a positive electrode (B+) of the first power supply BAT1. A first fixed contact (3) of the first single-pole double-throw switch SW2 is separately connected to a positive electrode (B+) of the second power supply BAT2 and a second fixed contact (2) of the second single-pole double-throw switch SW3. A moving contact (1) of the second single-pole double-throw switch SW3 and a negative electrode (B−) of the first power supply BAT1 are grounded together, and the first fixed contact (3) of the second single-pole double-throw switch SW3 and a negative electrode (B−) of the second power supply BAT2 are grounded together.

Referring to FIG. 13, the control unit 110 is configured to: when the robot is in a charging state, control the moving contact (1) of the first single-pole double-throw switch SW2 to be connected to the first fixed contact (3), and control the moving contact (1) of the second single-pole double-throw switch SW3 to be connected to the first fixed contact (3). In this case, a connection circuit between the first power supply BAT1 and the second power supply BAT2 is shown by a thick line. That is, the first power supply BAT1 and the second power supply BAT2 are in a parallel connection state. In this case, the voltage at the output terminal of the entire power supply module 200 is an output voltage of the first power supply BAT1 or an output voltage of the second power supply BAT2, that is, the second voltage.

Referring to FIG. 14, the control unit 110 is further configured to: when the robot is in a working state, control the moving contact (1) of the first single-pole double-throw switch SW2 to be connected to the second fixed contact (2), and control the moving contact (1) of the second single-pole double-throw switch SW3 to be connected to the second fixed contact (2). In this case, a connection circuit between the first power supply BAT1 and the second power supply BAT2 is shown by a thick line. That is, the first power supply BAT1 and the second power supply BAT2 are in a serial connection state. Therefore, the voltage at the output terminal of the entire power supply module 200 is a sum of output voltages of the first power supply BAT1 and the second power supply BAT2.

In addition, the control unit 110 control connection of the moving contacts and fixed contacts of the first single-pole double-throw switch SW2 and the second single-pole double-throw switch SW3 in a conventional control manner. In addition, in the aspect of determining whether the robot is in a working state or a charging state, the control unit 110 directly receive a state signal sent by an external device (for example, a mobile phone held by a user) to acquire the state of the robot. Alternatively, the control unit 110 determine the state of the robot. For example, after detecting that the robot has established a connection to the charging device, the control unit 110 determines that the robot enters a charging state. After charging ends, the control unit 110 communicate with the charging device to determine whether charging is completed. If determining that charging is completed, the control unit 110 determines that the robot starts to enter a working state. Alternatively, the user directly operates the switch unit 120 according to the state of the robot. In this case, the control unit 110 is not required.

Further, referring to FIG. 13 and FIG. 14, the robot power supply apparatus further includes a switch circuit SW1. The switch circuit SW1 is connected between the power supply module 200 and the load in the robot, and is connected to the control circuit 100. Specifically, the switch circuit SW1 is connected to the control unit 110 in the control circuit 100. The switch circuit SW1 has a conducting state and an off state.

When the robot is in a working state, the switch circuit SW1 enters a conducting state under the control of the control circuit 100. In this case, the power supply module 200 supply power to the load. When the robot is in a charging state, the switch circuit SW1 enters an off state under the control of the control circuit 100. In this case, the power supply module 200 is in a charging process.

In an embodiment, the robot power supply apparatus further include a plurality of vehicle-mounted charging units (not shown). Each power supply is separately connected to each vehicle-mounted charging unit in a one-to-one correspondence. The vehicle-mounted charging unit is used to establish an electrical connection to the charging device to charge each power supply.

Each power supply is separately connected to each vehicle-mounted charging unit in a one-to-one correspondence. In other words, a quantity of vehicle-mounted charging units is the same as that of the power supplies. In addition, there is no connection relationship between the vehicle-mounted charging unit, to ensure that the respective connected power supplies are separately charged. The vehicle-mounted charging unit and the charging device use a charging technology for a conventional mobile robot to charge the power supplies. For example, the vehicle-mounted charging unit and the charging device use a contact charging technology to perform charging. In this case, the vehicle-mounted charging unit is provided with a male connector, and the charging device is provided with a female connector. It is only necessary to align and connect the male connector and the female connector to perform charging. The contact charging technology is a top automatic charging mode (that is, a contact used to connect the charging device is located at the top of the body of the robot), a side automatic charging mode (that is, a contact used to connect the charging device is located on a side surface of the robot), a bottom automatic charging mode (that is, a contact used to connect the charging device is located at the bottom of the body of the robot), and the like. In addition, the vehicle-mounted charging unit and the charging device are charged by using a contactless inductive charging technology. The contactless inductive charging technology is a charging manner of using an electromagnetic induction principle to transfer energy in a contactless coupling manner. For example, a separate high-frequency transformer forms a coupler between the vehicle-mounted charging unit and the charging device, and inductive coupling is used to transmit energy in a contactless manner.

It may be understood that, a connection manner between the vehicle-mounted charging unit and the power supply is not limited to the foregoing case, provided that it is ensured that the charging device separately charge each power supply. For example, there may be only one vehicle-mounted charging unit, and the vehicle-mounted charging unit is directly connected to each power supply by a change-over switch. In this way, during charging of the robot, the vehicle-mounted charging unit close a connection circuit to one power supply and charge the power supply. After charging is completed, the vehicle-mounted charging unit then closes a connection circuit of a next power supply to perform charging. This process is repeated sequentially until all the power supplies have been charged.

Another implementation provides a robot, including a load and the foregoing robot power supply apparatus provided in the previous implementation. The load is connected to the robot power supply apparatus.

It should be noted that the principle of the robot power supply apparatus in the robot provided in this implementation of the present invention is the same as that of the robot power supply apparatus provided in the foregoing implementation. Details are not described herein again.

The embodiments of the present invention have been described above. The foregoing descriptions are exemplary rather than exhaustive, and are not limited to the disclosed embodiments. Various changes and variations are obvious to a person of ordinary skill in the art without departing from the scope and spirit of the described embodiments. Therefore, the protection scope of the present invention should be defined by the protection scope of the claims.

What is claimed is:

1. A self-moving snow removal device protecting a human or an object from damage by thrown snow or miscellaneous matter, comprising:

a moving unit configured to drive the self-moving snow removal device to move;

a working motor, a snow removing head and a snow thrower cylinder having a safe flow guide plate at an end portion of the snow thrower cylinder, wherein the snow removing head is driven by the working motor to collect accumulated snow and miscellaneous matter on a ground and throw the accumulated snow and miscellaneous matter out through the snow thrower cylinder to a maximum height in air from the ground; and a control circuit configured to control at least one of a rotational speed of the snow removing head and a throwing angle of the safe flow guide plate in association with the other to restrict a maximum height to be not greater than a predetermined snow throwing height safety threshold, wherein the predetermined snow throwing height safety threshold is set to a value ranging from 0.8 meters to 1.1 meters.

2. The self-moving snow removal device according to claim 1, wherein the control circuit is further configured to control a set of power supplies to be serially connected when the self-moving snow removal device is in a working state.

3. The self-moving snow removal device according to claim 2, wherein the predetermined snow throwing height safety threshold is 0.8 meters.

4. The self-moving snow removal device according to claim 1, wherein:

the self-moving snow removal device further comprises a snow throwing mechanism;

the snow throwing mechanism comprises the snow removing head rotating around a central axis, and the working motor that drives the snow removing head to rotate to collect the accumulated snow and miscellaneous matter on the ground into the snow throwing mechanism; and the control circuit is configured to: when it is detected that a throwing speed reaches a predetermined speed threshold, control a snow throwing height to be less than the predetermined snow throwing height threshold.

5. The self-moving snow removal device according to claim 4, wherein a value range of the predetermined speed threshold is 18 meters/second to 19 meters/second.

6. The self-moving snow removal device according to claim 5, wherein a radius of the snow removing head is 0.088 meters, and the rotational speed of the snow removing head is 1800 revolutions/minute to 2000 revolutions/minute.

7. The self-moving snow removal device according to claim 4, wherein a speed at which the snow throwing mechanism throws a thrown object is referred to as a throwing speed, an initial throwing angle relative to a horizontal direction is a throwing angle, and a height of a throwing point is an initial height, wherein at least one of the throwing speed, the throwing angle, and the initial height is controlled to control the snow throwing height.

8. The self-moving snow removal device according to claim 7, wherein a radius of the snow removing head is 0.08 meters to 0.12 meters, and the rotational speed of the snow removing head is 1500 revolutions/minute to 2500 revolutions/minute.

9. The self-moving snow removal device according to claim 7, wherein the initial height is controlled to be 200 mm to 800 mm.

10. The self-moving snow removal device according to claim 7, wherein the throwing speed is controlled to be 15 m/s to 20 m/s.

11. The self-moving snow removal device according to claim 7, wherein the throwing angle is controlled to be −10 degrees to 25 degrees.

12. The self-moving snow removal device according to claim 1, further comprising simultaneously controlling a snow throwing distance to satisfy a predetermined requirement.

13. The self-moving snow removal device according to claim 7, wherein the initial height and a radius of the snow removing head are given, and the rotational speed of the snow removing head and/or the throwing angle are controlled to control the snow throwing height.

14. The self-moving snow removal device according to claim 13, wherein:

the snow throwing mechanism further comprises a snow thrower roller and the snow thrower cylinder, and the snow thrower roller provides the thrown object from the snow removing head with secondary power and throws the thrown object from the snow thrower cylinder.

15. The self-moving snow removal device according to claim 14, wherein at least one of the rotational speed of the snow removing head, a rotational speed of the snow thrower roller, and the throwing angle is controlled to control the snow throwing height.

16. The self-moving snow removal device according to claim 1, wherein the control circuit adjusts a speed of the moving unit according to a thickness of snow to enable the snow throwing height to be not greater than the predetermined snow throwing height safety threshold.

17. The self-moving snow removal device according to claim 16, wherein when the thickness of snow is less than 4 cm, the control circuit controls a moving speed of the moving unit to be 20 m/min to 30 m/min or when the thickness of snow is greater than 4 cm, the control circuit controls the moving speed of the moving unit to be 10 m/min to 25 m/min.

18. The self-moving snow removal device according to claim 4, further comprising a combination of a throwing height control structure and/or a thrown object energy control structure:

a baffle structure disposed at an end portion of the snow throwing mechanism, wherein a baffle angle is adjustable, and the baffle angle is adjusted to adjust the throwing angle;

a grating disposed inside or at the end portion of the snow throwing mechanism, and configured to block miscellaneous matter to reduce miscellaneous matter in a thrown object; and a pocket having an air-permeable function or a porous structure.

19. A safe snow throwing method for controlling a self-moving snow removal device to protect a human or an object from damage by snow or miscellaneous matter, wherein the self-moving snow removal device comprises a moving unit, a working unit, and a control circuit, the safe snow throwing method comprising:

driving, by the moving unit, the self-moving snow removal device to move;

driving, by a working motor, a snow throwing mechanism to collect accumulated snow and miscellaneous matter on a ground and throw the accumulated snow and miscellaneous matter out of the snow throwing mechanism, wherein a maximum height of a thrown object in air from the ground is referred to as a snow throwing height, the snow throwing mechanism having a safe flow guide plate at an end portion of a thrower cylinder; and controlling, by the control circuit, at least one of a rotational speed of a snow removing head and a throwing angle of the safe flow guide plate in association with the other to restrict a maximum height to be not greater than a predetermined snow throwing height safety threshold, wherein the predetermined snow throwing height safety threshold is set to a value ranging frombetvleen 0.8 meters to 1.1 meters.

20. A self-moving snow removal device protecting a human or an object from damage by thrown snow or miscellaneous matter, comprising:

a moving unit configured to drive the self-moving the snow removal device to move; and a working unit, comprising a working motor and a snow throwing mechanism driven by the working motor, wherein the snow throwing mechanism is driven by the working motor to collect accumulated snow and miscellaneous matter on a ground and throw the accumulated snow and miscellaneous matter out of the snow throwing mechanism, the snow throwing mechanism having a safe flow guide plate at an end portion of a thrower cylinder, and a maximum height of a thrown object in air from the ground is referred to as a snow throwing height, at least one of a rotational speed of a snow removing head and a throwing angle of the safe flow guide plate in association with the other to restrict the maximum height to be not greater than a predetermined snow throwing height safety threshold, wherein the predetermined snow throwing height safety threshold is set to a value ranging from 0.8 meters to 1.1 meters.

* * * * *